US006727056B2

(12) United States Patent
Fujita et al.

(10) Patent No.: US 6,727,056 B2
(45) Date of Patent: Apr. 27, 2004

(54) DIRECT POSITIVE PHOTOGRAPHIC SILVER HALIDE EMULSION AND COLOR PHOTOGRAPHIC LIGHT-SENSITIVE MATERIAL COMPRISING SAME

(75) Inventors: Munehisa Fujita, Kanagawa (JP); Atsushi Matsunaga, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 08/915,683

(22) Filed: Aug. 21, 1997

(65) Prior Publication Data

US 2004/0033451 A1 Feb. 19, 2004

Related U.S. Application Data

(63) Continuation of application No. 08/474,715, filed on Jun. 7, 1995, now abandoned.

(30) Foreign Application Priority Data

Jun. 9, 1994 (JP) ..... 6-150616
Jun. 9, 1994 (JP) ..... 6-150620

(51) Int. Cl.[7] ..... G03C 1/005

(52) U.S. Cl. ..... 430/569; 430/567; 430/217; 430/603

(58) Field of Search ..... 430/567, 569, 430/217, 603

(56) References Cited

U.S. PATENT DOCUMENTS 4,504,570 A * 3/1985 Evans et al. ..... 430/570
4,797,354 A * 1/1989 Saitou et al. ..... 430/567
4,835,095 A * 5/1989 Ohashi et al. ..... 430/567
4,853,322 A 8/1989 Makino et al. ..... 430/567
4,945,037 A * 7/1990 Saitou ..... 430/567
5,081,009 A * 1/1992 Tanemura et al. ..... 430/567
5,087,555 A * 2/1992 Saitou ..... 430/567
5,104,784 A * 4/1992 Shuto et al. ..... 430/567
5,110,719 A * 5/1992 Shuto et al. ..... 430/567
5,204,235 A * 4/1993 Yamamoto et al. ..... 430/569
5,210,013 A * 5/1993 Tsaur et al. ..... 430/567
5,411,849 A * 5/1995 Hasegawa ..... 430/569
5,468,602 A * 11/1995 Takahashi ..... 430/569

FOREIGN PATENT DOCUMENTS

JP B 64 8327 2/1989

* cited by examiner

*Primary Examiner*—Mark F. Huff
*Assistant Examiner*—Amanda Walke
(74) *Attorney, Agent, or Firm*—Sughrue Mion, PLLC

(57) ABSTRACT

The present invention provides a tabular internal latent image type direct positive photographic silver halide emulsion which provides a high sensitivity and a low re-reversal negative sensitivity and a color diffusion transfer photographic light-sensitive material comprising such an emulsion. The present invention also provides an internal latent image type direct positive photographic silver halide emulsion which can be prepared with a good reproducibility and a color diffusion transfer photographic light-sensitive material less susceptible to variation of sensitivity and S/N ratio comprising such an emulsion. An internal latent image type direct positive photographic silver halide emulsion comprising tabular silver halide grains having an average grain diameter of not less than 0.3 μm and an aspect ratio (diameter of silver halide grain in circle equivalence/thickness of silver halide grain) of from not less than 2 to not more than 100 in an amount of not less than 50% of all silver halide grains as calculated in terms of area is provided, wherein the average grain thickness a along the main plane of the external shell thereof is from not less than 0.2 μm to not more than 1.5 μm and the average grain thickness b perpendicular to the main plane of the external shell thereof is from not less than 0.04 μm to not more than 0.30 μm. An internal latent image type direct positive photographic silver halide emulsion is provided, which is prepared from a seed crystal emulsion which has been prepared via desalting process.

5 Claims, 1 Drawing Sheet

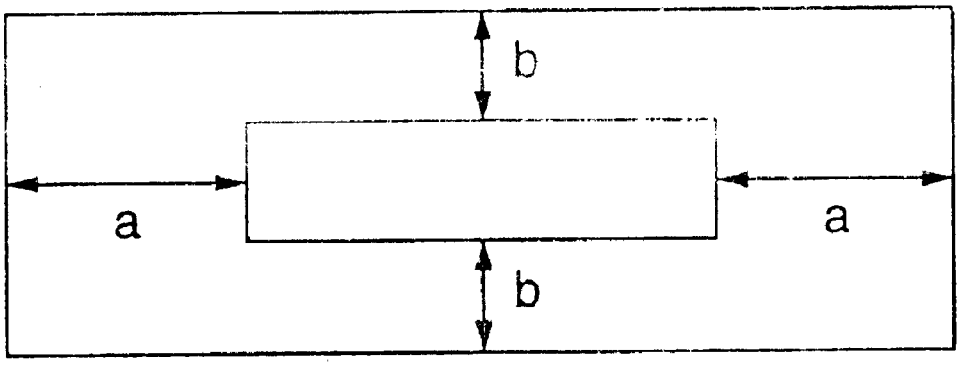
b
a
a
b

DIRECT POSITIVE PHOTOGRAPHIC SILVER HALIDE EMULSION AND COLOR PHOTOGRAPHIC LIGHT-SENSITIVE MATERIAL COMPRISING SAME

This is a Continuation of application Ser. No. 08/474,715 filed Jun. 7, 1995 now abn.

FIELD OF THE INVENTION

The present invention relates to an internal latent image type direct positive photographic silver halide emulsion and a color diffusion transfer photographic light-sensitive material comprising such an internal latent image type direct positive photographic silver halide emulsion.

BACKGROUND OF THE INVENTION

The silver halide system photography is superior to other photographic processes such as electrophotography and diazo process in sensitivity and gradation characteristics and thus has heretofore been most widely used. A known example of the silver halide system photography is a photographic process for the formation of a direct positive image. In this photography, an internal latent image type direct positive photographic silver halide emulsion is developed with a surface developer (developer which leaves the latent image forming position inside silver halide grains substantially undeveloped) while being uniformly exposed to light or in the presence of a nucleator as disclosed in U.S. Pat. No. 3,761,276 and JP-B-60-55821 (The term "JP-B" as used herein means an "examined Japanese patent publication").

The direct positive photographic silver halide emulsion is superior to the negative type emulsion in that it may be processed only once to obtain a positive image.

In general, an internal latent image type direct positive photographic silver halide emulsion is prepared by a process which comprises mixing a soluble silver salt with a soluble halide in an aqueous solution of gelatin to form silver halide grains (hereinafter referred to as "core grains"), subjecting the core grains to chemical sensitization, depositing a silver halide on the core grains to form a shell thereon, desalting the emulsion, and then optionally subjecting the emulsion to chemical sensitization.

For example, JP-B-52-34213 (corresponding to U.S. Pat. No. 3,761,276) discloses an internal latent image type emulsion useful for a direct positive emulsion. This emulsion comprises silver halide grains which contains a doping agent inside and has been chemically sensitized on its surface. This is also disclosed in U.S. Pat. No. 3,317,322 to Porter et al.

The present invention relates to an emulsion of tabular silver halide grains. Processes for the preparation of such an emulsion of tabular silver halide grains and techniques using such an emulsion of tabular silver halide grains are disclosed in Cleve, "Photography: Theory and Practice", 1930, page 131, Gutoff, "Photographic Science and Engineering", vol. 14, pp. 248–257, 1970, U.S. Pat. Nos. 4,434,226, 4,414,310, 4,433,048, 4,439,520, 4,414,306, 4,459,353, British Patent 2,112,157, JP-A-59-99433 (The term "JP-A" as used herein means an "unexamined published Japanese patent application") and JP-A-62-209445. In particular, tabular internal latent image type direct positive photographic silver halide emulsions are described in detail in U.S. Pat. Nos. 4,395,478, 4,504,570 and 4,996,137, JP-B-64-8327, JP-A-1-131547, JP-A-1-154142, JP-A-1-158429 and JP-A-1-297649. These tabular internal latent image type direct positive photographic silver halide emulsions are advantageous in that they exhibit an excellent sharpness and undergo development rapidly to provide a direct positive image having a small dependence on development temperature.

However, the tabular internal latent image type direct positive photographic silver halide emulsions thus prepared are disadvantageous in that they can easily form a re-reversed negative image which frequently occurs when exposed to light at a high intensity.

As an approach for solving this problem to minimize the formation of re-reversed negative image there is taught in U.S. Pat. Nos. 3,367,778, 3,287,136 and 4,395,478 a method which comprises doping polyvalent metal ions into silver halide grains. However, this process cannot provide sufficient improvements when applied to tabular internal latent image type direct positive photographic silver halide emulsions.

It has thus been desired to develop a tabular internal latent image type direct positive photographic silver halide emulsion which can hardly form a re-reversed negative image while maintaining its excellent characteristics.

These emulsions leave something to be desired in stability in production.

For the method for the preparation of an emulsion of tabular grains, reference can be made to JP-A-58-113927, JP-A-58-113928, JP-A-58-127921 and JP-A-1-158426. However, these methods require a prolonged period of time to form grains and thus present a big productivity problem. Further, these methods leave something to be desired in scale dependence during the formation of grains and reproducibility. In particular, the preparation of tabular internal latent image type direct positive photographic silver halide emulsions is complicated and requires a prolonged period of time, showing a poor reproducibility.

On the other hand, as an approach for stabilizing the formation of grains there is known a so-called seed crystal method which comprises the growth of seed crystal grains which have been separately prepared. However, this method has never been applied to internal latent image type direct positive emulsions. Further, as a method for preparing tabular grains by seed crystal method there is disclosed in JP-B-3-46811 a grain formation method using spherical seed crystal grains (aspect ratio: 1). However, the grains obtained by this method have an aspect ratio of not more than 3.0. Thus, this method cannot provide grains having a high aspect ratio.

Moreover, JP-A-61-112142, JP-A-62-58237 and JP-A-55-142329 disclose a grain formation method using polytwin grains. This method is suitable for the preparation of tabular grains having a high aspect ratio. However, this method is disadvantageous in that the grains thus obtained are susceptible to variation of characteristics unless seed crystals which have been desalted and redispersed are allowed to grow rapidly. Thus, this method leaves something to be desired in stability in production.

Further, JP-A-3-196136 and JP-A-3-196137 disclose a technique which comprises the formation of grains in the presence of a silver oxidizing agent. However, this technique has never been applied to the preparation of seed crystal emulsions.

As mentioned above, the stability in the preparation of an internal latent image type direct positive photographic silver halide emulsion, particularly a tabular internal latent image type direct positive photographic silver halide emulsion, presents a big problem. Nevertheless, no good solutions have been found.

SUMMARY OF THE INVENTION

It is therefore an object of the present invention to provide a tabular internal latent image type direct positive photographic silver halide emulsion which exhibits a high sensitivity and is less susceptible to the formation of re-reversed negative image and a color diffusion transfer photographic light-sensitive material comprising such a tabular internal latent image type direct positive photographic silver halide emulsion.

It is another object of the present invention to provide an internal latent image type direct positive photographic silver halide emulsion (particularly tabular internal latent image type direct positive photographic silver halide emulsion) having an excellent production stability and a color diffusion transfer photographic light-sensitive material comprising such an internal latent image type direct positive photographic silver halide emulsion.

These and other objects of the present invention will become more apparent from the following detailed description and examples.

The first aspect of the present invention is an internal latent image type direct positive photographic silver halide emulsion comprising tabular silver halide grains having an average grain diameter of not less than 0.3 μm and an aspect ratio (diameter of silver halide grain in circle equivalence/thickness of silver halide grain) of from not less than 2 to not more than 100 in an amount of not less than 50% of all silver halide grains as calculated in terms of area, wherein the average grain thickness a along the main plane of the external shell thereof is from not less than 0.2 μm to not more than 1.5 μm and the average grain thickness b perpendicular to the main plane of the external shell thereof is from not less than 0.04 μm to not more than 0.30 μm.

The second aspect of the present invention is the internal latent image type direct positive photographic silver halide emulsion as defined in the first aspect above, which is prepared from a seed crystal emulsion which has been prepared via desalting process.

The third aspect of the present invention is the internal latent image type direct positive photographic silver halide emulsion as defined in the first aspect above, wherein grains are subjected to chemical sensitization in the presence of at least one compound selected from the group consisting of compounds represented by the following formula (A), (B) or (C):

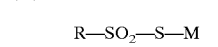

$$R—SO_2—S—M \quad (A)$$

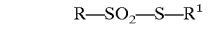

$$R—SO_2—S—R^1 \quad (B)$$

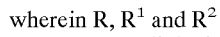

$$R—SO_2S—(L)_m—SSO_2—R^2 \quad (C)$$

wherein R, $R^1$ and $R^2$ may be the same or different and each represents an aliphatic group, aromatic group or heterocyclic group; M represents a cation; L represents a divalent linking group; m represents 0 or an integer of 1; the compounds of the formula (A), (B) or (C) may be each in the form of polymer containing as a repeating unit a divalent group derived from the structures represented by the formulae (A), (B) and (C), respectively; and R, $R^1$, $R^2$ and L may be optionally connected to each other to form a ring.

The fourth aspect of the present invention is the internal latent image type direct positive photographic silver halide emulsion as defined in the third aspect above, wherein the chemical sensitization of core grains is effected in the presence of at least one compound selected from the group consisting of the compounds represented by the formula (A), (B) or (C) and a gold sensitizer in combination under the condition that substantially no thiosulfate ion is present during the chemical sensitization.

The fifth aspect of the present invention is the internal latent image type direct positive photographic silver halide emulsion as defined in the third aspect above, wherein the silver halide phase of the external shell is formed in the presence of at least one compound selected from the group consisting of the compounds represented by the formula (A), (B) or (C).

The sixth aspect of the present invention is the internal latent image type direct positive photographic silver halide emulsion as defined in the third aspect above, which is prepared from a seed crystal emulsion which has been prepared via desalting process.

The seventh aspect of the present invention is the internal latent image type direct positive photographic silver halide emulsion as defined in the first aspect above, wherein the average grain thickness a along the main plane of the external shell thereof is from not less than 0.4 μm to not more than 1.0 μm and the average grain thickness b perpendicular to the main plane of the external shell thereof is from not less than 0.06 μm to not more than 0.15 μm.

The eighth aspect of the present invention is the internal latent image type direct positive photographic silver halide emulsion as defined in the first aspect above, wherein the thickness of grains are so uniform that the coefficient of variation of thickness is not more than 30%.

The ninth aspect of the present invention is a color diffusion transfer photographic light-sensitive material comprising at least one photosensitive silver halide emulsion layer combined with a dye image-forming substance provided on a support, said dye image-forming substance comprising a nondiffusive compound represented by the following formula (I) which releases a diffusive dye or precursor thereof or changes in its diffusivity in connection with silver development, wherein said at least one silver halide emulsion layer comprises at least one internal latent image type direct positive photographic silver halide emulsion as defined in the first aspect:

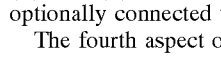

$$(DYE-Y)_n-Z \quad (I)$$

wherein DYE represents a dye group or a dye group or dye precursor group whose absorption wavelength has been temporarily shifted to short wavelength; Y represents a mere bond or bridging group; Z represents a group which makes difference in the diffusivity of the compound represented by $(DYE-Y)_n-Z$ or releases DYE to make difference in diffusivity between the released DYE and $(DYE-Y)_n-Z$ in correspondence or counter correspondence to a photosensitive silver salt having an imagewise latent image; and n represents an integer of 1 or 2, with the proviso that when n is 2, the plurality of (DYE–Y)'s may be the same or different.

The tenth aspect of the present invention is an internal latent image type direct positive photographic silver halide emulsion, prepared from a seed crystal emulsion which has been prepared via desalting process.

BRIEF DESCRIPTION OF THE DRAWING

By way of example and to make the description more clear, reference is made to the accompanying drawing in which:

The FIGURE is a diagrammatic view illustrating the thickness of the external shell of an emulsion grain wherein a represents the thickness along the main plane and b represents the thickness perpendicular to the main plane.

DETAILED DESCRIPTION OF THE INVENTION

The constitution of the present invention will be further described hereinafter.

The present invention can be applied to internal latent image type direct positive photographic silver halide emulsions. In the present invention, the internal latent image type direct positive photographic silver halide emulsion (hereinafter optionally referred to as "internal latent image type silver halide emulsion") is a silver halide emulsion which forms a latent image mainly inside silver halide grains when imagewise exposed to light. The silver halide emulsion exhibits the following properties. In some detail, the silver halide emulsion is applied to a transparent support in a predetermined amount, exposed to light for a predetermined period of time of 0.01 to 1 second, developed with the following developer A ("internal type" developer) at a temperature of 20° C. for 5 minutes, and then measured for maximum density. Separately, another sample which has been exposed to light in the same manner as above is developed with the following developer B ("surface type" developer) at a temperature of 20° C. for 5 minutes, and then measured for maximum density. The maximum density of the former sample is defined to be at least 5 times that of the latter sample.

The maximum density herein is determined by an ordinary photographic density measuring method.

| Developer A | |
|---|---|
| N-methyl-p-aminophenol sulfite | 2 g |
| Sodium sulfite anhydrate | 90 g |
| Hydroquinone | 8 g |
| Sodium carbonate (monohydrate) | 52.5 g |
| Potassium bromide | 5 g |
| Potassium iodide | 0.5 g |
| Water to make | 1 l |
| **Developer B** | |
| N-methyl-p-aminophenol sulfite | 2.5 g |
| 1-Ascorbic acid | 10 g |
| Potassium metanitrate | 35 g |
| Potassium bromide | 1 g |
| Water to make | 1 l |

Examples of the internal latent image type silver halide emulsion include conversion type silver halide emulsion as disclosed in U.S. Pat. Nos. 2,456,953 and 2,592,250, laminated structure type silver halide emulsion differing in halogen composition from first phase to second phase as disclosed in U.S. Pat. No. 3,935,014, and core/shell type silver halide emulsion comprising metal ion-doped or chemically sensitized core grains coated by a shell. Particularly preferred among these internal latent image type silver halide emulsions is core/shell silver halide emulsion. Examples of such a core/shell silver halide emulsion include those described in U.S. Pat. Nos. 3,206,313, 3,317,322, 3,761,266, 3,761,276, 3,850,637, 3,923,513, 4,035,185, 4,184,878, 4,395,478, 4,504,570, JP-A-57-136641, JP-A-61-3137, JP-A-61-299155 and JP-A-62-208241.

In order to obtain a direct positive image, the foregoing internal latent image type silver halide emulsion which has been imagewise exposed to light may be subjected to secondary uniform exposure to light on the entire surface of the exposed layer before or during development ("optical fogging" as disclosed in U.S. Pat. No. 1,151,363) or developed in the presence of a nucleator ("chemical fogging" as disclosed in *Research Disclosure,* vol. 151, No. 15162, (November 1976), pp. 76–78). In the present invention, it is preferred that "chemical fogging" is employed to obtain a direct positive image. The nucleator employable in the present invention will be described later.

As mentioned above, the internal latent image type silver halide emulsion which has been imagewise exposed to light may be subjected to secondary uniform exposure to light on the entire surface before or during development or developed in the presence of a nucleator to obtain a direct positive image. Examples of the nucleator employable in the present invention include hydrazines as disclosed in U.S. Pat. Nos. 2,563,785 and 2,588,982, hydrazides and hydrazones as disclosed in U.S. Pat. No. 3,227,552, heterocyclic quaternary salt compounds as disclosed in British Patent 1,283,835, JP-A-52-69613, JP-A-55-138742, JP-A-60-11837, JP-A-62-210451, JP-A-62-291637, U.S. Pat. Nos. 3,615,515, 3,719,494, 3,734,738, 4,094,683, 4,115,122, 4,306,016 and 4,471,044, sensitizing dyes containing nucleating substituents in its molecule as disclosed in U.S. Pat. No. 3,718,470, thiourea bond type acylhydrazine compounds as disclosed in U.S. Pat. Nos. 4,030,925, 4,031,127, 4,245,037, 4,255,511, 4,266,013 and 4,276,364 and British Patent 2,012,443, and acylhydrazine compounds having thioamide ring or heterocyclic group such as triazole and tetrazole bonded thereto as adsorption group as disclosed in U.S. Pat. Nos. 4,080,270 and 4,278,748 and British Patent 2,011,391B.

The amount of the nucleator to be used herein is preferably such that a sufficient maximum density can be provided when the internal latent image type emulsion is developed with a surface developer. Actually, the amount of the nucleator to be used varies with the characteristics of the silver halide emulsion used, the chemical structure of the nucleator used and the development conditions. Accordingly, the optimum content of the nucleator can vary widely. The actual useful content of the nucleator ranges from about 0.1 mg to 5 g, preferably from about 0.5 mg to 2 g per mol of silver. If the nucleator is incorporated in a hydrophilic colloidal layer adjacent to the emulsion layer, the content of the nucleator may be the same as above based on the amount of silver contained in the internal latent image type emulsion on the same area as the emulsion.

The present invention can also be applied to tabular internal latent image type direct positive photographic silver halide emulsions. In the present invention, the external shell (hereinafter optionally referred to as "shell") is a silver halide phase which is formed on silver halide grains for forming an internal shell (hereinafter optionally referred to as "core") which grains have been chemically sensitized in the process for the preparation of an emulsion.

The internal latent image type silver halide grains to be used in the present invention preferably have a core/shell structure.

The preparation of shell can be accomplished in accordance with examples disclosed in JP-A-63-151618 and U.S. Pat. Nos. 3,206,316, 3,317,322, 3,761,276, 4,269,927 and 3,367,778. In this case, the core/shell molar ratio (by weight) is preferably from 1/30 to 5/1, more preferably from 1/20 to 2/1, particularly from 1/20 to 1/1.

The preparation of tabular grains can be accomplished by methods as disclosed in Gutoff, "Photographic Science and Engineering", vol. 14, pp. 248–257, 1970.

A method which comprises charging into a reaction vessel for the preparation of an emulsion silver halide grains which have been previously formed by precipitation, and U.S. Pat.

Nos. 4,334,012, 4,301,241 and 4,150,994 are preferred as the case may be. These grains may be used as seed crystals or may be provided as silver halide to grow. In the latter case, an emulsion having a small grain size is preferably added. The emulsion may be entirely added at once, or may be batchwise added, or may be continuously added. In order to modify the surface of the gains, it is effective that grains having various halogen compositions are added as the case may be.

Besides the method which comprises adding a soluble silver salt and a halogen salt at a constant concentration and a constant flow rate to cause the growth of grains, a method which comprises varying the concentration or flow rate of these salts to be added to cause the growth of grains as disclosed in British Patent 1,469,480 and U.S. Pat. Nos. 3,650,757 and 4,242,455 is preferred. By increasing the concentration or flow rate of these salts to be added, the supplied amount of silver halide can be varied as a first-order function, second-order function or more complicated function of addition time. As necessary, it is preferred that the supplied amount of silver halide be decreased as the case may be. Alternatively, a method which comprises adding a plurality of soluble silver salts having different solution compositions is useful. Further, a method which comprises increasing the supplied amount of one of a plurality of soluble halogen salts having different solution compositions while decreasing the supplied amount of the other is useful.

The mixer in which the soluble silver salt solution and the soluble halogen salt solution are reacted can be selected from those disclosed in U.S. Pat. Nos. 2,996,287, 3,342,605, 3,415,650 and 3,785,777, West German Patent Application (OLS) Nos. 2,556,885 and 2,555,364.

In order to accelerate the growth of grains, the rate, amount and concentration at which a silver salt solution (e.g., aqueous solution of $AgNO_3$) and a halide solution (e.g., aqueous solution of KBr) are added are preferably increased during the preparation of an emulsion containing tabular grains. For these methods, reference can be made to British Patent 1,335,925, U.S. Pat. Nos. 3,672,900, 3,650,757 and 4,242,445, JP-A-55-142329 and JP-A-55-158124.

In the preparation of an emulsion of the present invention, a salt of metal ion is preferably present in the system during the formation of grains, during the desalting process, during the chemical sensitization, or before coating depending on the purpose. Thus, by doping metal ions into the grains, the maximum allowable excess exposure that cause no re-reversal can be increased or the minimum density can be reduced. If the metal ions are doped into the grains, they are preferably added during the formation of grains. If the metal ions are used to modify the surface of the grains or as chemical sensitizers, they are preferably added between after the formation of grains and before the completion of the chemical sensitization. The grains may be entirely doped with metal ions. Alternatively, only a part of the core, shell or epitaxial portion of the grains may be doped with metal ions. Further, only substrate grains may be doped with metal ions. Examples of the metal ions employable in the present invention include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi ions. Preferred among these metal ions are Fe, Co, Ru, Ir, Pt, Au and Pb ions. Particularly preferred among these metal ions are Fe, Ru, Ir and Pb ions.

These metals may be added in the form of salt soluble during the formation of grains such as ammonium salt, acetate, nitrate, sulfate, phosphate, hydroxide, six-coordinate complex and four-coordinate complex. Examples of such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $NH_4RhCl_6$ and $K_4Ru(CN)_6$. The ligand of these coordination compounds can be selected from the group consisting of halo, aco, cyano, cyanate, thiocyanate, nitrosyl, thionitrosyl, oxo and carbonyl. These metal compounds may be used singly or in combination.

The metal compound is preferably added in the form of solution in water or proper solvent such as methanol and acetone. In order to stabilize the solution, an aqueous solution of hydrogen halide (e.g., HCl, HBr) or alkali halide (e.g., KCl, NaCl, KBr, NaBr) can be added. If necessary, an acid or alkali may be added. The metal compound can be charged into the reaction vessel before the formation of grains or during the formation of grains. Alternatively, the metal compound can be added in admixture with a water-soluble silver salt (e.g., $AgNO_3$) or aqueous solution of alkali halide (e.g., NaCl, KBr, KI) continuously during the formation of silver halide grains. Further, the metal compound can be prepared in the form of solution separately from the solutions of the water-soluble silver salt and alkali halide, and then continuously added at a proper time during the formation of grains. Various addition methods may be employed in combination.

A chalcogenide compound as disclosed in U.S. Pat. No. 3,772,031 may be effectively added during the preparation of the emulsion as the case may be. Besides S, Se and Te, cyanate, thiocyanate, selenocyanate, carbonate, phosphate or acetate may be present in the system.

These methods are further described in U.S. Pat. Nos. 2,448,060, 2,628,167, 3,737,313 and 3,772,031 and *Research Disclosure,* vol. 134, No. 13452, (June 1975).

The crystal form of tabular grains may be selected from the group consisting of triangle, hexagon and circle. A regular hexagon six sides of which are almost the same as disclosed in U.S. Pat. No. 4,996,137 is a desirable form.

The emulsion of tabular grains of the present invention is an emulsion comprising silver halide grains having an aspect ratio (diameter of silver halide grain in circle equivalence/thickness of silver halide grain) of from not less than 2 to not more than 100 in an amount of not less than 50% of all silver halide grains as calculated in terms of area, preferably an emulsion comprising silver halide grains having an aspect ratio of not less than 5, more preferably from 5 to 8, in an amount of not less than 50%, preferably not less than 70%, particularly not less than 85% of all silver halide grains as calculated in terms of area. The diameter of tabular silver halide grain in circle equivalence is the diameter of two opposing parallel or almost parallel main planes in circle equivalence (diameter of the circle having the same projected area as that of the main plane). The grain thickness represents the distance between the main planes. If the aspect ratio of the tabular grain exceeds 100, it disadvantageously presents a problem that the emulsion grain is deformed or destroyed until an application of the emulsion to a support is performed.

The diameter of the tabular grain in circle equivalence is not less than 0.3 $\mu$m, preferably from 0.3 to 10 $\mu$m, more preferably from 0.4 to 5.0 $\mu$m, particularly from 0.4 to 3.0 $\mu$m.

The grain thickness is less than 1.5 $\mu$m, preferably from 0.05 to 1.0 $\mu$m.

Further, an emulsion comprising grains the thickness of which are so uniform that the coefficient of variation of thickness is not more than 30% is preferred. Moreover, an emulsion of grains which are defined in thickness and distance between twinning planes as disclosed in JP-A-63-163451 is preferred.

The measurement of the diameter and thickness of tabular grains can be determined from electrophotograph of grains as disclosed in U.S. Pat. No. 4,434,226.

The grain size of the emulsion to be used in the present invention can be determined from the diameter of circle corresponding to projected area measured under an electron microscope, the diameter of sphere corresponding to volume of grain calculated from projected area and grain thickness, or the diameter of sphere corresponding to volume determined by coulter counter method. The tabular grains of the present invention can be selected from tabular grains having a diameter in circle equivalence ranging from ultrafine grains having a diameter of not more than 0.05 $\mu$m to coarse grains having a diameter exceeding 10 $\mu$m. Tabular grains having a diameter of from not less than 0.1 $\mu$m to not more than 3 $\mu$m are preferred.

The size distribution of silver halide grains is arbitrary but is preferably monodisperse. The term "monodisperse" as used herein is meant to indicate a dispersion system of silver halide grains 95% by weight or number of which fall within ±60%, preferably ±40% from the number-average grain size. The number-average grain size herein means the number-average diameter of the projected area of silver halide grains.

The structure and preparation process of the monodisperse tabular grains are described in JP-A-63-151618, U.S. Pat. Nos. 3,574,628 and 3,655,394 and British Patent 1,413,748. These monodisperse emulsions may be used in admixture.

These silver halide composition of these grains may be any of silver bromide, silver bromoiodide, silver bromochloroiodide, silver bromochloride, silver bromoiodide and silver chloride. Preferred among these silver halides are silver bromide and silver bromoiodide. Other silver salts such as silver thiocyanate, silver cyanate, silver sulfide, silver selenide, silver carbonate, silver phosphate and organic silver salt may be added as separate grains or may be incorporated in the silver halide grains.

The silver halide grain may differ in phase from core to shell or may be composed of uniform phase. The silver halide composition in the grain may be uniform or may differ from core to shell. The grain may have a layer structure. (JP-A-57-154232, JP-A-58-108533, JP-A-58-248469, JP-A-59-48755, JP-A-59-52237, U.S. Pat. Nos. 3,505,068, 4,433,048 and 4,444,877, European Patent 100984 and British Patent 1,027,146) Further, grains having a dislocation line may be used.

If the silver halide grains have two or more silver halides in the form of mixed crystal or structure, it is essential to control the distribution of halogen composition between grains. For the measurement of the distribution of the halogen composition between grains, reference can be made to JP-A-60-254032. It is desirable that the distribution of halogen between grains be uniform. In particular, an emulsion which is so uniform as not more than 20% as calculated in terms of coefficient of variation is preferred. Another embodiment is an emulsion having a relationship between grain size and halogen composition.

It is essential to control the halogen composition in the vicinity of the surface of the grain. The rise in the silver iodide content or silver chloride content in the vicinity of the surface of the grain causes a change in the dye absorbability or development speed and thus can be selected depending on the purpose. In the case where the halogen composition in the vicinity of the surface of the grain is varied, the halogen composition in question may entirely surround the grain or may be attached to a part of the grain. For example, only one plane of a tetradecahedral grain composed of {100} faces and {111} faces may be subjected to change in halogen composition. Alternatively, either the main plane or side plane of a tabular grain may be subjected to change in halogen composition.

Two or more silver halide grains having different crystal habits, halogen compositions, grain sizes and grain size distributions can be used in combination. These silver halide grains may be incorporated in separate emulsion layers and/or same emulsion layer.

The crystal form of the tabular grain may be selected from the group consisting of triangle, hexagon and circle. A regular hexagon six sides of which are almost the same as disclosed in U.S. Pat. No. 4,996,137 is a desirable form.

The tabular grain can be observed for dislocation line under a transmission type electron microscope. Grains free of dislocation line, grains containing several dislocation lines or grains containing a large number of dislocation lines may be selected depending on the purpose. Dislocation can be linearly introduced into a grain along a specific direction in the orientation of the crystal. Alternatively, bent dislocation can be introduced into the grain. Dislocation can be entirely introduced into the grain. Alternatively, dislocation can be introduced into only a specific position of the grain. For example, dislocation can be introduced into only the fringe of the grain. Dislocation can be introduced not only into tabular grain but also into regular grain or amorphous grain such as pebble-like grain. For example, JP-A-63-220238 and JP-A-1-201649 disclose a tabular silver halide grain into which dislocation has been intentionally introduced.

The silver halide emulsion to be used in the present invention may be subjected to treatment for rounding the grain as disclosed in European Patents 96727B1 and 64412B1 or surface modification as disclosed in West German Patent 2,306,447C2 and JP-A-60-221320.

The grain normally has a smooth surface but is preferably intentionally roughened as the case may be. As described in JP-A-58-106532 and JP-A-60-221320, the crystal may have a hole on a portion thereof, e.g., apex or center of plane. Alternatively, raffle grain as disclosed in U.S. Pat. No. 4,643,966 may be used.

Two or more silver halide grains having different crystal habits, halogen compositions, grain sizes and grain size distributions can be used in combination. These silver halide grains may be incorporated in separate emulsion layers and/or same emulsion layer.

The preparation of silver halide grains to be used in the present invention can be accomplished by any suitable method as disclosed in *Research Disclosure* (RD) No. 17643 (December 1978), pp. 22–23, "I. Emulsion preparation and types", *RD* No. 18716 (November 1979), page 648, *RD* No. 307105 (November 1989), pp. 863–865, P. Glafkides, "Chimie et Physique Photographique", Paul Montel, (1967), G. F. Duffin, "Photographic Emulsion Chemistry", The Focal Press, (1966); and V. L. Zelikman et al., "Making and Coating Photographic Emulsion", The Focal Press, (1964). In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used as a style of the double jet process. According to the controlled double jet process, a silver halide emulsion having a regular crystal form and an almost uniform grain size can be obtained.

The preparation process and application technique of tabular silver halide grains have been described. The preparation of tabular silver halide grains can be easily accomplished by any suitable method as disclosed in Gutoff, "Photographic Science and Engineering", vol. 14, pp. 248–257, (1970), U.S. Pat. Nos. 4,434,226, 4,414,310, 4,433,048 and 4,439,520 and British Patent 2,112,157.

The monodisperse emulsion is further described in JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394 and British Patent 1,413,748.

A seed crystal emulsion can be provided as silver halide for grains growth. In this case, an emulsion having a small grain size is preferably added. Such an emulsion may be entirely added at once. Alternatively, such an emulsion may be batchwise added. Alternatively, such an emulsion may be continuously added. Grains having various halogen compositions may be effectively added to modify the surface of the emulsion grains as the case may be.

A method which comprises converting a large portion or only a portion of the halogen composition of silver halide grains by a halogen conversion method is disclosed in U.S. Pat. Nos. 3,477,852 and 4,142,900, EP 273,429, EP 273,430 and West German Patent Application (OLS) No. 3,819,241. This is a useful method for the formation of grains. In order to convert the halogen composition into a more difficultly soluble silver salt, a soluble halogen solution or silver halide grains may be added. The halogen conversion may be conduced at once, batchwise or continuously.

The internal latent image type silver halide grains to be used in the present invention preferably have a core/shell structure as mentioned above. For the preparation of shell, the chemical sensitization of the surface of core/shell grains prepared by depositing shell on the surface of chemically-sensitized core grains, the chemical sensitization of the emulsion in the presence of a chemical sensitizing aid, the reduction sensitization of the emulsion, and the sensitization of the emulsion with an oxidizer, the same methods as used for the foregoing tabular internal latent image type direct positive photographic silver halide emulsion can be employed.

The silver halide emulsion of the present invention is preferably prepared by coating chemically-sensitized core grains with a shell, and then chemically sensitizing the surface of the grains. The surface of the grains may not be chemically sensitized. In general, when the surface of the grains is chemically sensitized, it provides a high maximum density and hence good reversal properties. In order to chemically sensitize the surface of the grains, a polymer as disclosed in JP-A-57-13641 may be present in the system.

The foregoing chemical sensitization can be effected with an active gelatin as described in T. H. James, "The Theory of the Photographic Process", 4th ed., Macmillan, (1977), pp. 67–76. The chemical sensitization can also be effected with sensitizers such as sulfur, selenium, tellurium, gold, platinum, palladium, iridium, rhodium, osmium and rhenium, singly or in combination, at a pAg value of 5 to 10, a pH value of 4 to 8 and a temperature of 30° C. to 80° C. as described in *RD* Nos. 12008, vol. 120, (April 1974) and 13452, vol. 34, (June 1975), U.S. Pat. Nos. 2,642,361, 3,297,446, 3,772,031, 3,857,711, 3,901,714, 4,266,018 and 3,904,415 and British Patent 1,315,755.

The chemical sensitization may be effected in the presence of a chemical sensitization aid. As such a chemical sensitization aid employable in the present invention there may be used a compound which is known to inhibit fog and include sensitivity during chemical sensitization, such as azaindene, azapyridazine and azapyrimidine. Examples of chemical sensitization aids are described in U.S. Pat. Nos. 2,131,038, 3,411,914 and 3,554,757, JP-A-58-126536, JP-A-62-253159, and Duffin, "Photographic Emulsion Chemistry", pp. 138–143, The Focal Press, (1966).

As described in JP-B-58-1410 and Moisar et al., "Journal of Photographic Science", vol. 25, (1977), pp. 19–27, the silver halide emulsion may be subjected to reduction sensitization in the interior of the grains during the precipitation process.

Other examples of chemical sensitization include the following reduction sensitization methods. For example, as described in U.S. Pat. Nos. 3,891,446 and 3,984,249, hydrogen may be used to effect reduction sensitization. As described in U.S. Pat. Nos. 2,518,698, 2,743,182 and 2,743,183, a reducing agent may be used or a low pAg (e.g., lower than 5) or high pH (e.g., higher than 8) treatment may be conducted to effect reduction sensitization. Representative known examples of reduction sensitizers include stannous salt, ascorbic acid and derivative thereof, amine, polyamine, hydrazine derivative, formamidinesulfinic acid, silane compound, and borane compound. For the reduction sensitization for use in the present invention, these known reduction sensitizers may be selectively used. Two or more these reduction sensitizers may be used in combination. Preferred among the foregoing reduction sensitizers are stannous chloride, thiourea dioxide, dimethylamineborane, ascorbic acid, and derivative thereof.

Further, chemical sensitizing methods as disclosed in U.S. Pat. Nos. 3,917,485 and 3,966,476 may be employed.

Moreover, sensitizing methods with previously mentioned oxidizers may be employed. For the kind, usage, etc. of the oxidizers, reference can be made to the foregoing description.

In a preferred embodiment, the foregoing reduction sensitization may be used in combination with a silver oxidizer. The treatment with such a silver oxidizer may be followed by the reduction sensitization or vice or versa. Alternatively, the two treatments may be effected at the same time. These treatments may be selectively effected during the formation of grains or chemical sensitization.

As a protective colloid for use in the preparation of an emulsion according to the present invention there may be advantageously used gelatin. Other hydrophilic colloids can be used.

Examples of the foregoing hydrophilic colloids employable in the present invention include protein such as gelatin derivative, graft polymer of gelatin with other high molecular compounds, albumin and casein, cellulose derivative such as hydroxyethyl cellulose, carboxymethyl cellulose and sulfuric ester of cellulose, sugar derivative such as sodium alginate and starch derivative, and various hydrophilic high molecular compounds such as homopolymer and copolymer, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole.

As the foregoing gelatin there may be used lime-processed gelatin as well as acid-processed gelatin or enzyme-processed gelatin as described in Bull. Soc. Sci. Photo. Japan. No. 16, page 30, (1966). Further, a hydrolyzate of gelatin or product of enzymatic decomposition of gelatin may be used.

For the selection of protective colloid, washing for desalting, spectral sensitization with a sensitizing dye, use of various fog inhibitors and photographic stabilizers for the purpose of inhibiting the drop of sensitivity or minimizing the formation of fog, etc., reference can be made to the foregoing tabular internal latent image type direct positive photographic silver halide emulsion.

Gelatin contains a large amount of impurity ions. Gelatin which has been ion-exchanged to reduce its content of inorganic impurity ions may be preferably used. In particular, gelatin which has been ion-exchanged to reduce its Ca content to not more than 100 ppm, preferably not more than 30 ppm may be used to provide good results.

The emulsion of the present invention is preferably washed with water for desalting, and then dispersed in a protective colloid which has been just prepared. The washing temperature may be selected depending on the purpose. It is preferably between 5° C. and 50° C. The pH value at which washing is effected may be selected depending on the purpose. It is preferably between 2 and 10, more preferably between 3 and 8. The pAg value at which washing is effected may be selected depending on the purpose. It is preferably between 5 and 10. Washing can be selectively accomplished by noodle washing, dialysis with a semipermeable membrane, centrifugation, coagulation sedimentation or ion exchanging. The coagulation sedimentation method can be accomplished by the use of a sulfate, organic solvent, washing polymer, gelatin derivative or the like.

In the present invention, spectral sensitization can be effected with a sensitizing dye. Examples of dyes to be used in the spectral sensitization include cyanine dye, melocyanine dye, complex cyanine dye, complex melocyanine dye, holopolar cyanine dye, hemicyanine dye, styryl dye and hemioxonol dye. Specifically, sensitizing dyes as disclosed in U.S. Pat. No. 4,617,257, JP-A-59-180550, JP-A-60-140335, JP-A-61-160739, *RD* 17029 (June 1978), pp. 12–13 and *RD* 17643 (December 1978), page 23 can be used.

These sensitizing dyes can be used singly or in combination. A combination of these sensitizing dyes is often used particularly for the purpose of supersensitization. Representative examples of such a combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

Besides these sensitizing dyes, a dye which does not exert a spectral sensitizing effect itself or a substance which does not substantially absorb visible light but exerts a supersensitizing effect may be incorporated in the emulsion (as disclosed in U.S. Pat. Nos. 3,615,613, 3,615,641, 3,617,295, 3,635,721, 2,933,390 and 3,743,510 and JP-A-63-23145).

These sensitizing dyes for spectral sensitization may be added to the emulsion at any stage in the preparation of the emulsion which has heretofore been known useful. In general, it may be added between the completion of chemical sensitization and the coating. As described in U.S. Pat. Nos. 3,628,969 and 4,225,666, it may be added at the same time with the chemical sensitizer to effect spectral sensitization and chemical sensitization at the same time. Alternatively, as described in JP-A-58-113928, it may be added before the chemical sensitization or it may be added before the completion of the precipitation of silver halide grains to initiate the spectral sensitization. Further, as taught in U.S. Pat. No. 4,225,666, the above mentioned compound may be added batchwise, that is, part of the compound may be added before the chemical sensitization and the rest of the compound may be added after the chemical sensitization. As taught in U.S. Pat. No. 4,183,756, it may be added at any stage during the formation of silver halide grains.

These dyes can be used in an amount of $10^{-8}$ to $10^{-2}$ mole per mol of silver halide. In the case of silver halide grain size of from 0.2 to 1.2 $\mu$m, which is preferably used, the added amount of these dyes is preferably in the range of about $5\times10^{-5}$ to $2\times10^{-3}$ mol per mol of silver halide.

The coated amount of the photosensitive silver halide is in the range of 1 mg to 10 g/m$^2$ as calculated in terms of silver.

The process for the preparation of a silver halide emulsion for production stability in the present invention can be roughly divided into two steps, i.e., step of preparing a seed crystal emulsion and step of preparing an internal latent image type direct positive photographic silver halide emulsion including the growth of seed crystal grains.

The step of preparing a seed crystal emulsion comprises a step of forming grains, including nucleation, physical ripening and growth, followed by desalting and washing.

The step of preparing an internal latent image type direct positive photographic silver halide emulsion including the growth of seed crystal grains comprises a step of allowing the grains to grow further in the presence of the foregoing seed crystal grains (step of forming core grains), followed by a step of chemical sensitizing the core grains, a step of forming a shell on the core grains, a step of desalting and washing the grains, a step of chemical sensitization of the shell, etc. The seed crystal grains may be immediately subjected to chemical sensitization, followed by the foregoing treatments.

The seed crystal grains according to the present invention will be further described hereinafter.

In the present invention, seed crystal grains having various crystal forms may be used. Examples of these crystal forms include regular crystal forms such as cube, octahedron, tetradecahedron and rhombic dodecahedron, irregular crystal forms such as sphere and plate, crystal forms having a high order face ({hkl} face), and mixture thereof. For details, reference can be made to the grain form of the foregoing internal latent image type direct positive photographic silver halide emulsion. In particular, a tabular seed crystal emulsion can be advantageously used.

The emulsion of tabular grains of the present invention is an emulsion comprising silver halide grains having an average grain diameter of not less than 0.3 $\mu$m and an aspect ratio (diameter of silver halide grain in circle equivalence/thickness of silver halide grain) of from not less than 2.0 to not more than 100, preferably from not less than 2.0 to not more than 10.0, particularly from not less than 3.0 to not more than 8.0 in an amount of not less than 50%, preferably not less than 70%, particularly not less than 85% of all silver halide grains as calculated in terms of projected area. The average diameter of tabular seed crystal grain for use in the present invention in sphere equivalence is preferably not more than 1.5 $\mu$m, particularly from not less than 0.2 $\mu$m to not more than 1.0 $\mu$m. The average thickness of the tabular seed crystal grains for use in the present invention is preferably not more than 1.5 $\mu$m, particularly not more than 0.50 $\mu$m.

The tabular seed crystal grains for use in the present invention may be composed of any of silver bromide, silver bromoiodide, silver chloride, silver bromochloride, silver bromochloroiodide and silver chloroiodide. Preferred among these silver halides are silver bromide, silver bromoiodide, silver chloride, and silver bromochloride. Particularly preferred among these silver halides is silver bromide.

The tabular seed crystal grains for use in the present invention may have at least two layers having substantially different halogen compositions thereinside or a uniform halogen composition.

The grain size distribution is preferably so monodisperse that the coefficient of variation of grain size is not more than 20%.

The preparation of the tabular seed crystal emulsion for use in the present invention will be described hereinafter.

In the present invention, a water-soluble silver salt and an aqueous solution of a halide are simultaneously added to an aqueous solution of gelatin in a reaction vessel. The mixture is then ripened to form tabular nuclear grains. The tabular nuclear grains thus obtained are then allowed to grow.

Silver to be added during the formation of grains may be partially or entirely supplied as finely divided silver halide grains as described in JP-A-62-99751.

The tabular seed crystal grains for use in the present invention can be prepared in accordance with the foregoing known method for the preparation of a tabular silver halide emulsion except for the usage of the silver salt defined herein.

In the present invention, it is essential that the tabular seed crystal emulsion be washed for desalting and then dispersed in a protective colloid which has been just prepared. The washing and dispersion processes will be further described later.

The step of preparing an internal latent image type direct positive photographic silver halide emulsion, including the growth of seed crystal grains for use in the present invention, will be described hereinafter.

The amount of the seed crystal emulsion to be used in this step is arbitrary and is preferably not more than 5 times, more preferably not more than twice, further preferably equal or less, particularly 1/10 the molar amount of the silver salt supplied for growth as calculated in terms of silver. The period of time during which the seed crystal emulsion which has been prepared can be allowed to stand is arbitrary. Preferably, the seed crystal emulsion may be used after one or more days of refrigeration.

The growth in the presence of seed crystal grains can be effected in the same manner as in the foregoing preparation of seed crystal grains.

Further, the effect of the present invention becomes remarkable when an oxidizer, particularly a compound represented by the foregoing formula (A), (B) or (C) is used.

The silver oxidizer to be used in the preparation of the seed crystal emulsion for use in the present invention is a compound which serves to act on and convert metal silver to silver ion. In particular, a compound which converts extremely small silver atom by-produced in the formation of silver halide grains to silver ion is useful. The silver ion thus produced may form a difficultly water-soluble silver salt such as silver halide, silver sulfate and silver selenide or may form a water-soluble silver salt such as silver nitrate.

The foregoing silver oxidizer may be either inorganic or organic.

Examples of the oxidizer are described in JP-A-61-3134 and JP-A-61-3136. Examples of the inorganic oxidizer include ozone, hydrogen peroxide and adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2.6H_2O)$, permanganate (e.g., $KMnO_4$), oxygen acid salt such as chromate (e.g., $K_2Cr_2O_7$), halogen such as iodine and bromine, perhalogenic acid salt (e.g., potassium periodate), salt of metal having a high atomic value (e.g., ferric potassium hexacyanoate), and thiosulfonate.

Examples of the organic oxidizer include quinones such as p-quinone, organic peroxides such as peracetate and perbenzoate, and compound which releases an active halogen (e.g., N-bromosuccinimide, chloramine T, chloramine B).

Preferred among these oxidizers are inorganic oxidizers such as ozone, hydrogen peroxide, adduct thereof, halogen and thiosulfonate, and organic oxidizers such as quinone.

More preferably, a thiosulfate may be used. Such a thiosulfonate can be selected from the group consisting of the compounds represented by the foregoing formula (A), (B) or (C).

In the preparation of the seed crystal emulsion for use in the present invention, at least one of the foregoing silver oxidizers is incorporated in the system at any step, preferably at a step of formation of grains or after a step of washing for desalting, during the preparation of grains.

The oxidizer may be previously charged into the reaction vessel. Preferably, the oxidizer is added at a proper time during the formation of grains. Alternatively, the silver oxidizer may be previously added to an aqueous solution of a water-soluble silver salt or water-soluble alkali halide which is then used for the formation of grains. Alternatively, the silver oxidizer may be batchwise added along with the formation of grains or continuously added over a prolonged period of time.

The added amount of the silver oxidizer is preferably from $10^{-7}$ to $10^{-1}$ mol, more preferably from $10^{-6}$ to $10^{-2}$ mol, most preferably from $10^{-5}$ to $10^{-3}$ mol per mol of silver halide.

In order to incorporate the silver oxidizer in the system during the preparation of the seed crystal emulsion, a method commonly used for the addition of additives to a photographic emulsion can be applied. In some detail, the silver oxidizer may be added in the form of an aqueous solution having a proper concentration, if it is a water-soluble compound, or solution in an organic solvent miscible with water such as alcohol, glycol, ketone, ester and amide which has no adverse effect on photographic characteristics, if it is a water-insoluble or difficultly water-soluble compound.

Referring further to the thiosulfonic compound represented by the foregoing formula (A), (B) or (C), the aliphatic group represented by R, $R^1$ or $R^2$ is a saturated or unsaturated straight-chain, branched or cyclic aliphatic hydrocarbon group, preferably $C_{1-22}$ alkyl group or $C_{2-22}$ alkenyl or alkinyl group which may be further substituted.

Examples of the foregoing alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the foregoing alkenyl group include allyl and butenyl. Examples of the foregoing alkinyl group include propargyl and butynyl.

Examples of the aromatic group represented by R, $R^1$ or $R^2$ include monocyclic or condensed aromatic groups. Preferred examples of such an aromatic group include $C_{6-20}$ aromatic group such as phenyl and naphthyl. These aromatic groups may be further substituted.

The heterocyclic group represented by R, $R^1$ or $R^2$ is a 3- to 15-membered ring containing at least one element selected from the group consisting of nitrogen, oxygen, sulfur, selenium and tellurium and at least one carbon atom. This heterocyclic group is preferably a 3- to 6-membered heterocyclic ring. Examples of such a 3- to 6-membered heterocyclic ring include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of the substituents on R, $R^1$ and $R^2$ include alkyl group (e.g., methyl, ethyl, hexyl), alkoxy group (e.g., methoxy, ethoxy, octyloxy), aryl group (e.g., phenyl, naphthyl, tollyl), hydroxy group, halogen atom (e.g., fluorine, chlorine, bromine, iodine), aryloxy group (e.g., phenoxy), alkylthio group (e.g., methylthio, butylthio), arylthio group (e.g., phenylthio), acyl group (e.g., acetyl, propionyl, butyryl, valeryl), sulfonyl group (e.g., methylsulfonyl, phenylsulfonyl), acylamino group (e.g., acetylamino, benzoylamino), sulfonylamino group (e.g., methanesulfonylamino, benzenesulfonylamino), acyloxy group (e.g., acetoxy, benzoxy), carboxyl group, cyano group, sulfo group, amino group, —$SO_3SM$ group (in which M represents a monovalent cation), and —$SO_2R^1$ group (in which $R^1$ is as defined above).

Examples of the divalent linking group represented by L include atom such as C, N, S and O or atomic group containing at least one such atom. Specific examples of such a divalent linking group include alkylene group, alkenylene group, alkinylene group, —O—, —S—, —NH—, —CO—, —$SO_2$—, singly or in combination.

L is preferably a divalent aliphatic group or divalent aromatic group. Specific examples of the divalent aliphatic group represented by L include xylylene group and the following groups:

$-(CH_2)_n-$ ($n$=1~12), $-CH_2-CH=CH-CH_2-$, $-CH_2C\equiv CCH_2-$,

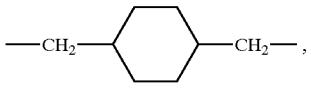

Specific examples of the divalent aromatic group represented by L include phenylene group, and naphthylene group.

These substituents may be further substituted by the foregoing substituents.

M preferably is a metal ion or organic cation. Examples of such a metal ion include lithium ion, sodium ion, and potassium ion. Examples of such an organic cation include ammonium ion (e.g., ammonium, tetramethyl ammonium, tetrabutyl ammonium), phosphonium ion (e.g., tetraphenyl phosphonium), and guanidyl group.

If the compound represented by the formula (A), (B) or (C) is a polymer, examples of repeating unit constituting the polymer include the following compounds:

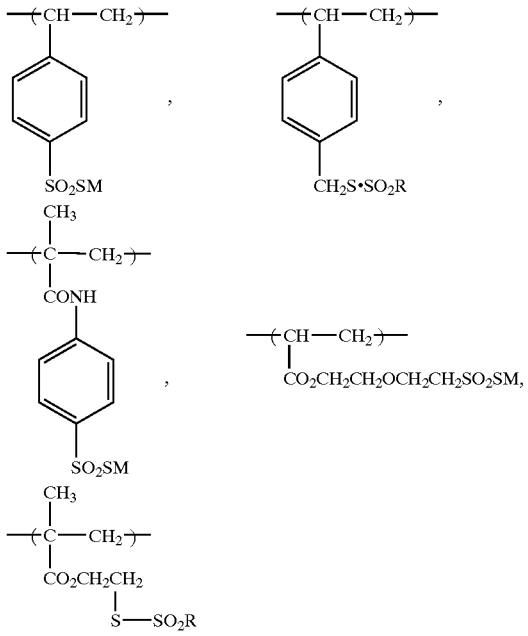

These polymers may be homopolymers or copolymers with other copolymerizable monomers.

The synthesis of the compound represented by the formula (A), (B) or (C) can be easily accomplished by a method described or cited in JP-A-54-1019, British Patent 972,211, Journal of Organic Chemistry, vol. 53, page 396, (1988), and Chemical Abstracts, vol. 59, 9776e.

The added amount of the compound represented by the formula (A), (B) or (C) is preferably from $10^{-7}$ to $10^{-1}$ mol, more preferably from $10^{-7}$ to $10^{-3}$ mol, particularly from $10^{-6}$ to $10^{-4}$ mol per mol of silver halide.

In order to incorporate the compound represented by the formula (A), (B) or (C) in the system during the preparation of the emulsion, a method commonly used for the addition of additives to a photographic emulsion can be applied. In some detail, the compound may be added in the form of an aqueous solution having a proper concentration, if it is a water-soluble compound, or solution in an organic solvent miscible with water such as alcohol, glycol, ketone, ester and amide which has no adverse effect on photographic characteristics, if it is a water-insoluble or difficultly water-soluble compound.

The compound represented by the formula (A), (B) or (C) needs to be present in the stage of formation of external shell during the formation of silver halide grains. The compound may be added at any step before the beginning of the formation of external shell. Preferably, the compound is added during the chemical sensitization of internal shell (core). Alternatively, the compound represented by the formula (A), (B) or (C) may be previously added to an aqueous solution of a water-soluble silver salt or water-soluble alkali halide which is then used for the formation of grains. Alternatively, the compound represented by the formula (A), (B) or (C) may be batchwise added along with the formation of grains or continuously added over a prolonged period of time.

In the present invention, the compound represented by the formula (A) is most preferred.

Specific examples of the compound represented by the formula (A), (B) or (C) will be listed below, but present invention should not be construed as being limited thereto.

(1-1) $CH_3SO_2SNa$
(1-2) $C_2H_5SO_2SNa$
(1-3) $C_3H_7SO_2SK$
(1-4) $C_4H_9SO_2SLi$
(1-5) $C_6H_{13}SO_2SNa$
(1-6) $C_8H_{17}SO_2SNa$
(1-7) $CH_3(CH_2)_3CH(C_2H_5)CH_2SO_2S{\bullet}NH_4$
(1-8) $C_{10}H_{21}SO_2SNa$
(1-9) $C_{12}H_{25}SO_2SNa$
(1-10) $C_{16}H_{33}SO_2SNa$
(1-11) $(CH_3)_2CH{-}SO_2SK$
(1-12) $t\text{-}C_4H_9SO_2Na$
(1-13) $CH_3OCH_2CH_2SO_2S{\bullet}Na$
(1-14) 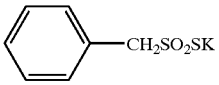
(1-15) $CH_2{=}CHCH_2SO_2SNa$
(1-16) 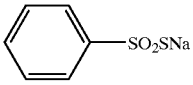
(1-17) 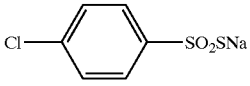
(1-18) 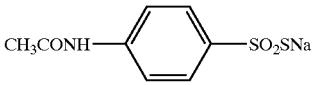
(1-19) 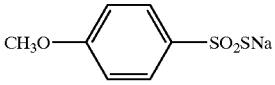
(1-20) 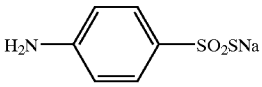
(1-21) 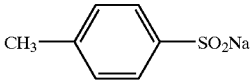
(1-22) 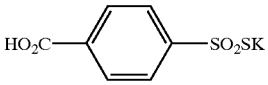
(1-23) 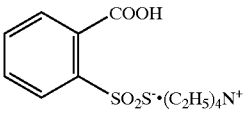
-continued
(1-24) 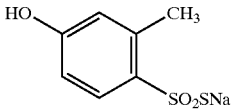
(1-25) 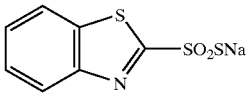
(1-26) 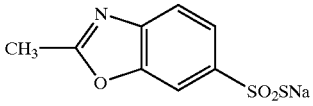
(1-27) 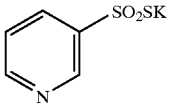
(1-28) 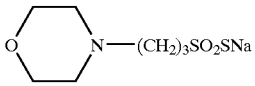
(1-29) $KSSO_2(CH_2)_2SO_2SK$
(1-30) $NaSSO_2(CH_2)_2SO_2SNa$
(1-31) $NaSSO_2(CH_2)_4S(CH_2)_4SO_2SNa$
(1-32) 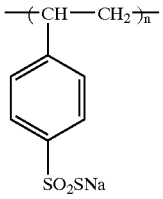
(1-33) 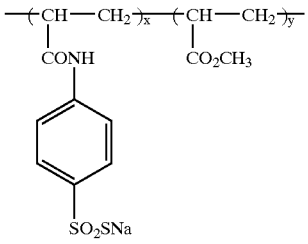
x:y = 1/1
(molar ratio)
(2-1) $C_2H_5SO_2S{-}CH_3$
(2-2) $C_8H_{17}SO_2SCH_2CH_3$
(2-3) 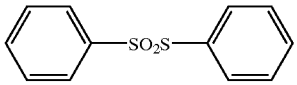
(2-4) 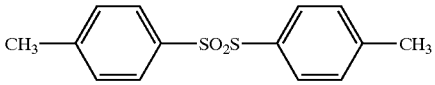
(2-5) $C_2H_9SO_2SCH_2CH_2CN$
(2-6) 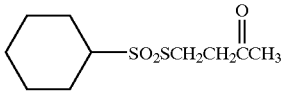

-continued (2-7)

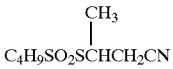

(2-8)

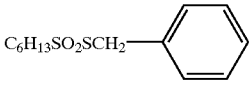

(2-9)

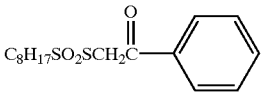

(2-10)

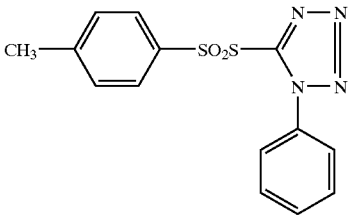

(2-11)

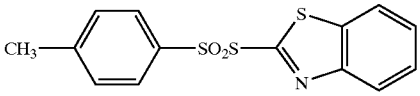

(2-12)

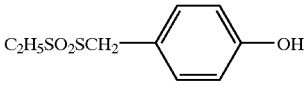

(2-13)

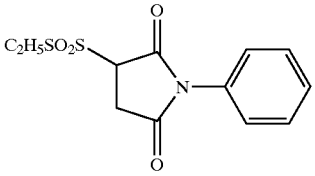

(2-14)

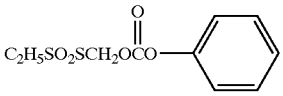

(2-15)

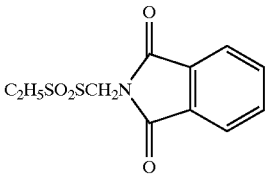

(2-16)

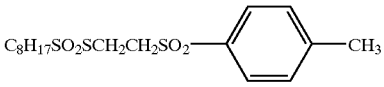

(2-17)

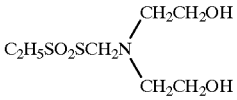

(2-18)

$C_2H_5SO_2SCH_2CH_2CH_2CH_2OH$ (2-19)

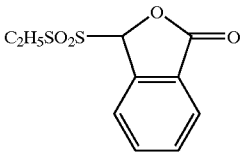

-continued (2-20)

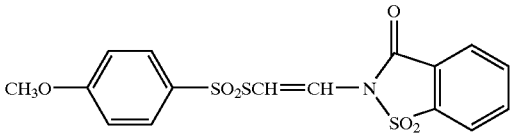

(2-21)

$CH_3SSO_2(CH_2)_4SO_2SCH_3$ (2-22)

$CH_3SSO_2(CH_2)_2SO_2SCH_3$ (2-23)

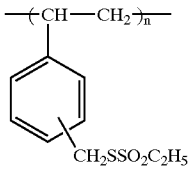

(2-24)

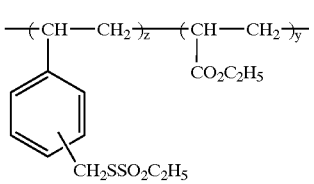

x:y = 2/1 (molar ratio)

(2-25)

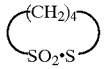

(3-1)

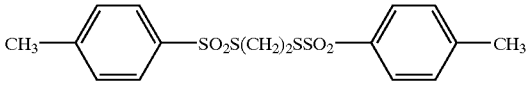

(3-2)

$C_2H_5SO_2SCH_2CH_2SO_2CH_2CH_2SSO_2C_2H_5$ (3-3)

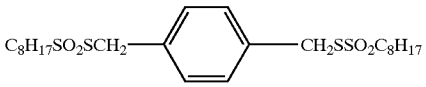

(3-4)

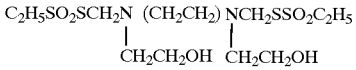

(3-5)

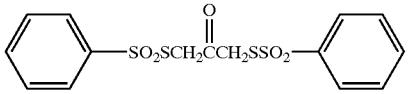

(3-6)

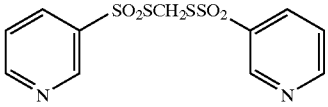

(3-7)

$C_2H_5SO_2SSSO_2C_2H_5$ (3-8)

$(n)C_3H_7SO_2SSSO_2C_3H_7(n)$ (3-9)\

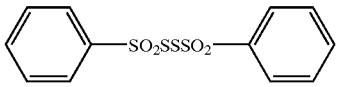

In the present invention, the foregoing seed crystal emulsion is used to prepare an internal latent image type direct positive photographic silver halide emulsion. The emulsion which has eventually been completed will be described hereinafter.

In the present invention, silver halide grains having various crystal forms may be used. Examples of these crystal forms include regular crystal forms such as cube, octahedron, tetradecahedron and rhombic dodecahedron, irregular crystal forms such as sphere and plate, crystal forms having a high order face ({hkl} face), and mixture thereof. For the details of grains having a high order face, reference can be made to Journal of Imaging Science, vol. 30, (1986), pp. 247–254.

The silver halide grains to be used in the present invention can be selected from the group consisting of regular crystal free of twinning plane, and twins as described in "Introduction to Photographic Industry: Silver Salt Photography", Society of Photographic Science and Technology of Japan, Corona, page 163, e.g., single twin having one twinning plane, parallel polytwin having two or more parallel twinning planes, nonparallel polytwin having two or more nonparallel twinning planes depending on the purpose.

U.S. Pat. No. 4,865,964 discloses that grains having different crystal forms are mixed. This approach may be used as necessary.

In the case of regular crystal, a cubic grain having {100} faces, an octahedral grain having {111} faces, or a dodecahedral grain having {110} faces as disclosed in JP-B-55-42737 and JP-A-60-222842 may be used. Further, a grain having {h11} faces such as {211} faces, a grain having {hh1} faces such as {331} faces, a grain having {hk0} faces such as {210} faces and a grain having {hk1} faces such as {321} faces as reported in Journal of Imaging Science, vol. 30, page 247, (1986) may be selectively used depending on the purpose although their preparation must be carefully designed.

A grain having two-or more different faces such as tetradecahedral grain having {110} faces and {111} faces, grain having {100} faces and {110} faces and grain having {111} faces and {110} faces may be selectively used depending on the purpose.

In the present invention, various fog inhibitors and photographic stabilizers may be used for the purpose of minimizing the sensitivity reduction or the generation of fog. Examples of these fog inhibitors and photographic stabilizers include azoles and azaindenes as disclosed in *RD* 17643 (1978), pp. 24–25, and U.S. Pat. No. 4,629,678, carboxylic acids and phosphoric acids containing nitrogen as disclosed in JP-A-59-168442, mercapto compounds and metal salts thereof as disclosed in JP-A-59-111636, and acetylene compounds as disclosed in JP-A-62-87957.

Further, various preservatives or mildewproofing agents such as phenethyl alcohol and 1,2-benzisothiazoline-3-one, n-butyl p-hydroxybenzoate, phenol, 4-chloro-3,5-dimethylphenol, 2-phenoxyethanol and 2-(4-thiazolyl) benzimidazole as disclosed in JP-A-63-257747, JP-A-62-272248 and JP-A-1-80941 can preferably be added. For details, reference can be made to EP-A-436938, line 25–line 28, page 150.

These additives are further described in *Research Disclosure* Nos. 17643 (December 1978), 18716 (November 1979) and 307105 (November 1989) as tabulated below.

| Kind of additive | RD 17643 (December 1978) | RD 18716 (November 1979) | RD 307105 (November 1989) |
|---|---|---|---|
| 1. Chemical sensitizer | p. 23 | p. 648 right column (RC) | p. 866 |

-continued

| Kind of additive | RD 17643 (December 1978) | RD 18716 (November 1979) | RD 307105 (November 1989) |
|---|---|---|---|
| 2. Sensitivity increasing agent | | p. 648 RC | |
| 3. Spectral sensitizer and supersensitizer | pp. 23–24 | p. 648 RC–p. 649 RC | pp. 866–868 |
| 4. Brightening agent | p. 24 | p. 647 | p. 868 |
| 5. Antifoggant and stabilizer | pp. 24–25 | p. 649 | pp. 868–870 |
| 6. Light absorbent, filter dye, and ultraviolet absorbent | pp. 25–26 | p. 649 RC–p. 650 left column (LC) | p. 873 |
| 7. Stain inhibitor | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

The various constituent elements of the present invention will be described hereinafter.

I. Photosensitive Sheet

A) Support

As the support for the photosensitive sheet to be used in the present invention there may be used any smooth transparent support commonly used for photographic light-sensitive material. Examples of such a support material include cellulose acetate, polystyrene, polyethylene terephthalate and polycarbonate. The support is preferably provided with an undercoating layer. The support preferably contains a slight amount of a dye or a pigment such as titanium oxide to inhibit light piping.

The thickness of the support is from 50 to 350 $\mu$m, preferably from 70 to 210 $\mu$m, more preferably from 80 to 150 $\mu$m.

As necessary, the support may be provided with a layer for curl balancing or an oxygen barrier layer as disclosed in JP-A-56-78833 on the back side thereof.

B) Image-receiving Layer

The dye image-receiving layer to be used in the present invention comprises a mordant incorporated in a hydrophilic colloid. The dye image-receiving layer may consist of a single layer or may have a multi-layer structure having a stack of mordants having different mordanting powers. For details, reference can be made to JP-A-61-252551. As the mordant there is preferably used a polymer mordant.

Examples of the polymer mordant include polymer containing secondary and tertiary amino group, polymer having a nitrogen-containing heterocyclic moiety and polymer containing quaternary cations having a molecular weight of not less than 5,000, particularly not less than 10,000.

The coated amount of the mordant is normally from 0.5 to 1.0 g/m$^2$, preferably from 1.0 to 5.0 g/m$^2$, particularly from 2 to 4 g/m$^2$.

Examples of the hydrophilic colloid to be used for the image-receiving layer include gelatin, polyvinyl alcohol, polyacrylamide, and polyvinyl pyrrolidone. Preferred among these hydrophilic colloids is gelatin.

The image-receiving layer may comprise a discoloration preventive as disclosed in JP-B-62-30620, JP-B-62-30621 and JP-A-62-215272 incorporated therein.

C) White Reflective Layer

The white reflective layer providing the white background for color image normally comprises a white pigment and a hydrophilic binder incorporated therein.

Examples of white pigment to be incorporated in the white reflective layer include barium sulfate, zinc oxide, barium stearate, silver flake, silicate, alumina, zirconium oxide, sodium sulfate, kaolin, mica and titanium dioxide. Further, a non-film-forming particulate polymer made of styrene may be used. These white pigments may be used singly. Alternatively, these white pigments may be used in admixture so far as a desirable reflectivity can be provided.

Particularly preferred among these white pigments is titanium dioxide.

The whiteness of the white reflective layer varies with the kind of the pigment used, the mixing ratio of the pigment and the binder and the coated amount of the pigment used. The light reflectance of the white reflective layer is preferably not less than 70%. In general, the more the coated amount of a pigment is, the higher is the whiteness. When an image-forming dye diffuses through the white reflective layer, the pigment resists the diffusion of the dye. Therefore, the coated amount of the pigment should be properly determined.

A white reflective layer having a titanium dioxide content of from 5 to 40 g/m$^2$, preferably from 10 to 25 g/m$^2$, and a light reflectance of from 78 to 85% at a wavelength of 540 mm is preferred.

In particular, rutile titanium dioxide is preferred.

Most of commercial titanium dioxide products are available in a form surface-treated with alumina, silica or zinc oxide. In order to provide a high reflectance, the percent surface treatment is preferably not less than 5%. Examples of commercially available titanium dioxide products include Ti-pure R931 available from Du Pont, and those described in *Research Disclosure* No. 15162, (November 1976).

Examples of the binder to be incorporated in the white reflective layer include alkali-permeable high molecular matrix such as gelatin, polyvinyl alcohol and cellulose derivative (e.g., hydroxyethylcellulose, carboxymethylcellulose).

Particularly preferred for white reflective layer among these binders is gelatin. The mixing ratio of white pigment and gelatin is normally from 1/1 to 20/1 (by weight), preferably from 5/1 to 10/1 (by weight).

The white reflective layer preferably comprises a discoloration preventive as disclosed in JP-B-62-30620 and JP-B-62-30621 incorporated therein.

D) Light-shielding Layer

A light-shielding layer containing a light-shielding agent and a hydrophilic binder may be provided interposed between the white reflective layer and the photosensitive layer.

As the light-shielding agent there may be used any material having a light-shielding function, preferably carbon black. Further, a decomposable dye as disclosed in U.S. Pat. No. 4,615,966 may be used.

As the binder in which the light-shielding agent is incorporated there may be used any material which can disperse carbon black therein, preferably gelatin.

As the carbon black starting material there may be used a material produced by any method such as channel method, thermal method and furnace method as described in Donnel Voet, "Carbon Black", Marcel Dekker, Inc., (1976). The grain size of carbon black is not specifically limited but is preferably from 90 to 1,800 Å. The added amount of the black pigment as light-shielding agent can be properly controlled depending on the sensitivity of the light-sensitive material to be shielded. The content of the black pigment is preferably adjusted such that the optical density reaches about 5 to 10.

E) Photosensitive Layer

In the present invention, a photosensitive layer comprising a silver halide emulsion layer combined with a dye image-forming substance is provided on the light-shielding layer. The constituent elements of the photosensitive layer will be further described hereinafter.

(1) Dye Image-forming Substance

The dye image-forming substance to be used in the present invention is a nondiffusive compound which releases a diffusive dye (optionally a dye precursor) or changes in its diffusivity in connection with the development of silver. Such a nondiffusive compound is described in "The Theory of the Photographic Process", 4th edition. Such a compound can be represented by the following formula (I):

$$(\text{DYE}-Y)_n-Z \qquad \text{(I)}$$

wherein DYE represents a dye group or a dye group or dye precursor group whose absorption wavelength has been temporarily shifted to short wavelength; Y represents a mere bond or bridging group; Z represents a group which makes difference in the diffusivity of the compound represented by $(\text{DYE}-\text{Y})_n-\text{Z}$ or releases DYE to make difference in diffusivity between the released DYE and $(\text{DYE}-\text{Y})_n-\text{Z}$ in correspondence or counter correspondence to a photosensitive silver salt having an imagewise latent image; and n represents an integer of 1 or 2, with the proviso that when n is 2, the plurality of (DYE–Y)'s may be the same or different.

The compound represented by the formula (I) can be roughly divided into two types, i.e., negative type compound which becomes diffusive on the silver development area and positive type compound which becomes diffusive on the undeveloped area, by the function of Z.

Specific examples of the group Z for negative type compound include a group which undergoes oxidation and cleavage upon development to release a diffusive dye.

Specific examples of the group Z are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Particularly preferred among groups represented by Z for negative type dye-releasing redox compound is N-substituted sulfamoyl group (substituent on N-position is a group derived from an aromatic hydrocarbon ring or heterocyclic group). Specific examples of such an N-substituted sulfamoyl group will be listed below, but the present invention is not limited thereto.

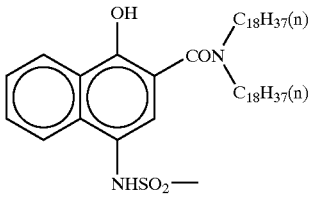

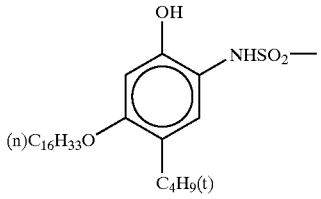

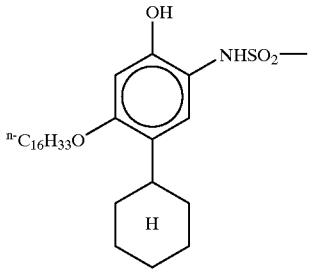

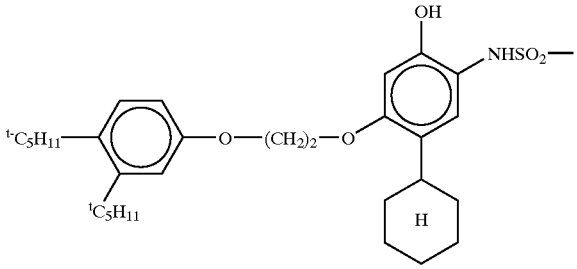

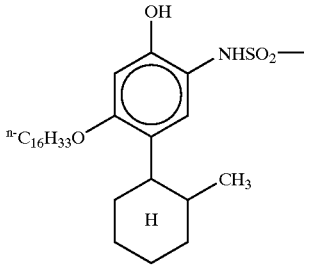

Examples of the positive type compound are described in "Angev. Chem. Int." Ed. Engl., 22, 191, (1982).

Specific examples of the positive type compound include a compound (dye developer) which initially stays diffusive under alkaline conditions but becomes nondiffusive when oxidized upon development. Representative examples of Y useful for this type of compound are described in U.S. Pat. No. 2,983,606.

Another type of a compound is a compound which undergoes self-ring closure to release a diffusive dye under alkaline conditions but substantially suspends the release of the diffusive dye when oxidized upon development. Specific examples of Y having such a function are described in U.S. Pat. Nos. 3,980,479, 3,421,964 and 4,199,355, JP-A-53-69033 and JP-A-54-130927.

A still further type of a compound is a compound which itself releases no dyes but releases dyes upon reduction. This type of a compound is used in combination with an electron donor. This compound reacts with the electron donor left unoxidized after imagewise development of silver to imagewise release a diffusive dye. Examples of atomic groups having such a function are described in U.S. Pat. Nos. 4,183,753, 4,142,891, 4,278,750, 4,139,379, 4,218,368, 4,278,750, 4,356,249 and 4,358,535, JP-A-53-110827, JP-A-53-110827, JP-A-54-130927, JP-A-56-164342, Kokai Giho 87-6199 and EP-A-220746.

Specific examples of these atomic groups will be listed below, but the present invention is not limited thereto.

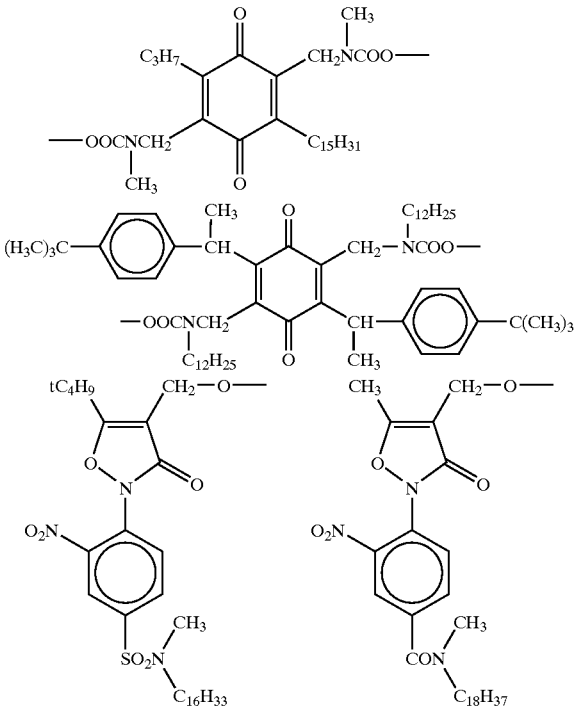

This type of a compound, if any, is preferably used in combination with a nondiffusive electron-providing compound (well known as ED compound) or precursor thereof. Examples of such an ED compound are described in U.S. Pat. Nos. 4,263,393 and 4,278,750 and JP-A-56-138736.

Examples of a still further type of a dye image-forming substance employable in the present invention include the following compounds:

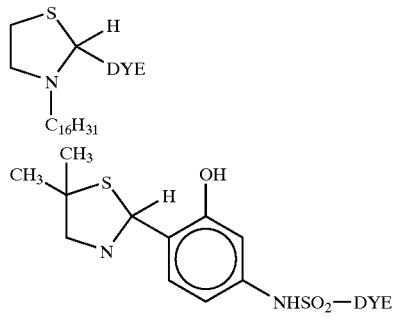

wherein DYE represents the same dye or precursor thereof as defined above.

For details, reference can be made to U.S. Pat. Nos. 3,719,489 and 4,098,783.

On the other hand, specific examples of the dye represented by DYE in the foregoing formula are described in the following references.

Examples of yellow dyes are described in U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072 and *Research Disclosure* Nos. 17630 (December 1978) and 16475 (December 1977).

Examples of magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of cyan dyes are described in U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431 and JP-A-56-71061, European Patents 53037 and 53040 and *Research Disclosure* Nos. 17630 (December 1978) and 16475 (December 1977).

These compounds may be dispersed in the system by a method as disclosed in JP-A-62-215272 (pp. 144–146). Such a dispersion may comprise a compound as disclosed in JP-A-62-215272 (pp. 137–144) incorporated therein.

(2) Silver Halide Emulsion

In the present invention, the foregoing tabular internal latent image type direct positive photographic silver halide emulsion can be used in combination with various type of internal latent image type direct positive photographic silver halide emulsions having various crystal forms.

The silver halide composition and size of these grains may be the same as that of the foregoing tabular internal latent image type direct positive photographic silver halide emulsions.

(3) Constitution of Photosensitive Layer

For the reproduction of natural colors by the subtractive color process, a photosensitive layer comprising at least two combinations of an emulsion spectrally sensitized with the above mentioned spectral sensitizing dye and the above mentioned dye image-forming substance which provides a dye having a selective spectral absorption in the same wavelength range as the spectral range is used. The emulsion and the dye image-forming substance may be coated on each other as separate layers or coated in admixture as one layer. If the above mentioned dye image-forming substance in the coated form exhibits absorption in the spectral sensitivity range of the emulsion to be combined therewith, they are preferably coated as separate layers. The emulsion layer may consist of a plurality of emulsion layers having different sensitivities. Any layers may be provided interposed between the emulsion layer and the dye image-forming layer. A layer containing a nucleation development accelerator as disclosed in JP-A-60-173541 or a partition layer as described in JP-B-60-15267 may be provided to increase the color image density. Alternatively, a reflective layer can be provided to increase the sensitivity of the photosensitive element.

Such a reflective layer is a layer containing a white pigment and a hydrophilic binder. Preferably, the white pigment is titanium oxide and the hydrophilic binder is gelatin. The coated amount of titanium oxide is from 0.1 $g/m^2$ to 8 $g/m^2$, preferably from 0.2 $g/m^2$ to 4 $g/m^2$. Examples of such a reflective layer are described in JP-A-60-91354.

In a preferred multilayer structure, a blue-sensitive emulsion combination unit, a green-sensitive emulsion combination unit and a red-sensitive emulsion combination unit are provided in this order as viewed from the exposure side.

Arbitrary layers may be optionally provided interposed between the various emulsion layer units. In particular, a color mixture preventive layer is preferably provided to prevent the development effect of one emulsion layer from having undesirable effects on other emulsion layers.

The color mixture preventive layer, if the developer is used in combination with a nondiffusive dye image-forming substance, preferably comprises a nondiffusive reducing agent to inhibit the diffusion of an oxidation product of the developer. Examples of such a nondiffusive reducing agent include hydroquinone, sulfonamide phenol and sulfonamide naphthol. Specific examples of such a nondiffusive reducing agent are described in JP-B-50-21249, JP-B-50-23813, JP-A-49-106329, JP-A-49-129535, JP-A-57-24941, JP-A-58-21249, U.S. Pat. Nos. 2,336,327, 3,360,290, 2,403,721, 2,544,640, 2,732,300, 2,782,659, 2,937,086, 3,637,393, 3,700,453 and British Patent 557,750. These reducing agents are preferably used in the form of dispersion in a polymer to inhibit undesirable migration thereof to an emulsion layer and control its activity. Preferred examples of such a polymer include polyvinylacetic acid, polymethyl methacrylate and polyacrylamide derivative. For the method for the dispersion of these reducing agents in the polymer, reference can be made to JP-A-60-238831 and JP-B-60-18978.

In the case where a compound which releases a diffusive dye when acted on by silver ions as described in JP-B-55-7576 is used, it is preferred that a compound which replenishes silver ions be incorporated in the color mixture preventive layer.

In the present invention, an anti-irradiation layer, UV absorbing layer, protective layer, etc. may be provided as necessary.

If necessary, a partition layer made of gelatin may be provided interposed between arbitrary adjacent layers.

Any layers constituting the foregoing photosensitive layer may comprise a development inhibitor precursor, a nondiffusive reducing agent or the like incorporated therein to inhibit fog and control photographic gradation.

As the hydrophilic binder to be used for the photosensitive layer there may be used any hydrophilic binder which is permeable to processing solutions and allows for the transfer of a dye image. Examples of such a hydrophilic binder include gelatin, polyacrylamide, polyvinyl alcohol and derivatives thereof.

The hydrophilic binder may be hardened with a hardener. Such a hardener may be added in an amount of from 0.5 to 5%, preferably from 0.5 to 2% based on the weight of the hydrophilic binder.

F) Peel Layer

In the present invention, a peel layer can be optionally provided to peel any portion of the photosensitive sheet off a unit after processing. Therefore, this peel layer must be easily peelable after processing. As the materials for this peel layer there can be used those described in JP-A-47-8237, JP-A-59-220727, JP-A-59-229555, JP-A-49-4653, JP-A-49-4334, JP-A-56-65133, JP-A-45-24075, U.S. Pat. Nos. 3,220,835, 4,,359,518, 3,227,550, 2,759,825, 4,401,746 and 4,366,227. A specific example of such materials is a water-soluble (or alkali-soluble) cellulose derivative. Examples of such a cellulose derivative include hydroxyethyl cellulose, cellulose acetate phthalate, plasticized methyl cellulose, ethyl cellulose, cellulose nitrate, and carboxymethyl cellulose. Other examples of such materials include various natural high molecular compounds such as alginic acid, pectin and gum arabic. Further examples of such materials include various modified gelatin such as acetylated gelatin and phthalated gelatin. Still further examples of such materials include water-soluble synthetic polymers such as polyvinyl alcohol, polyacrylate, polymethyl methacrylate, polybutyl methacrylate and copolymers thereof.

The peel layer may consist of a single layer or a plurality of layers as described in JP-A-59-220727 and JP-A-60-60642.

II. Cover Sheet

In the present invention, a transparent cover sheet having layers having a neutralizing function (neutralizing layer and neutralization timing layer) is used to allow uniform spread of processing solutions over the photosensitive element and neutralize an alkali thus processed, providing a stabilized image.

G) Support

As the support for the cover sheet employable in the present invention there may be used any smooth transparent support commonly used for photographic light-sensitive material. Examples of such a support material include cellulose acetate, polystyrene, polyethylene terephthalate and polycarbonate. The support is preferably provided with an undercoating layer.

The support preferably comprises a slight amount of a dye incorporated therein to inhibit light piping.

H) Layer Having Neutralizing Function

The layer having a neutralizing function to be used in the present invention is a layer containing an acidic substance in an amount enough to neutralize an alkali carried by the processing composition. As necessary, this layer may take a multi-layer structure consisting of a neutralization rate adjusting layer (timing layer), an adhesion intensifying layer and the like. A preferred example of such an acidic substance is a substance containing an acidic group having a pKa value of 9 or less (or a precursor group which undergoes hydrolysis to provide such an acidic group). Further preferred examples of such an acidic substance include higher aliphatic acids such as oleic acid as disclosed in U.S. Pat. No. 2,983,606, acrylic, methacrylic or maleic acid polymers and partial esters thereof or acid anhydrides thereof as disclosed in U.S. Pat. No. 3,362,819, copolymers of acrylic acid and acrylic ester as disclosed in French Patent 2,290,699, and latex type acidic polymers as disclosed in U.S. Pat. No. 4,139,383, and *Research Disclosure* No. 16102 (September 1977).

Other examples of such an acidic substance include those disclosed in U.S. Pat. No. 4,088,493, JP-A-52-153739, JP-A-53-1023, JP-A-53-4504, JP-A-53-4541 and JP-A-53-4542.

Specific examples of such an acidic polymer include copolymers of vinyl monomers such as ethylene, vinyl acetate and vinyl methyl ether with maleic anhydride, copolymers thereof with n-butylester, butyl acrylate and acrylic acid, cellulose acetate and hydrogen phthalate.

The above mentioned acidic polymers (i.e., polymeric acids) may be used singly or in admixture with a hydrophilic polymer. Examples of such a hydrophilic polymer include polyacrylamide, polymethyl pyrrolidone, polyvinyl alcohol (including partially-saponified products), carboxymethyl cellulose, hydroxymethyl cellulose, hydroxyethyl cellulose and polymethylvinyl ether. Particularly preferred among these hydrophilic polymers is polyvinyl alcohol.

The above mentioned polymeric acids may be used in admixture with a polymer other than hydrophilic polymer, such as cellulose acetate.

The coated amount of the polymeric acid is adjusted in accordance with the amount of an alkali to be developed over the photosensitive element. The equivalence ratio of polymeric acid to alkali per unit area is preferably in the range of 0.9 to 2.0. If the amount of the polymeric acid is too low, the hue of transferred dyes will change or stain will occur on the white background. On the contrary, if the amount of the polymeric acid is too high, it is disadvantageous in that the hue of dyes changes or the light resistance deteriorates. The above mentioned equivalence ratio is more preferably in the range of 1.0 to 1.3. In the case where the polymeric acid is used in admixture with a hydrophilic polymer, if the amount of the hydrophilic polymer is too low or high, the quality of the photograph will be deteriorated. The weight ratio of the hydrophilic polymer to the polymeric acid is in the range of 0.1 to 10, preferably 0.3 to 3.0.

The layer having a neutralizing function for use in the present invention may comprise various additives incorporated therein for various purposes. For example, in order to harden this layer, a film hardener known to those skilled in the art can be incorporated in the layer. Further, in order to reduce the brittleness of the film, a polyvalent hydroxyl compound such as polyethylene glycol, polypropylene glycol and glycerin can be incorporated in the layer. In addition to these additives, an oxidation inhibitor, a brightening agent, a development inhibitor and precursors thereof may be incorporated in the layer as necessary.

As the timing layer to be used in combination with the neutralizing layer there can be used a polymer which lowers the alkali permeability such as gelatin, polyvinyl alcohol, partially-acetylated product of polyvinyl alcohol, cellulose acetate and partially-hydrolyzed polyvinyl acetate, latex polymer which enhances the activation energy of alkali permeation, obtained by the copolymerization of a small amount of a hydrophilic comonomer such as acrylic monomer, polymer containing lactone ring, or the like.

Particularly useful examples of such a timing layer include timing layers comprising cellulose acetate as disclosed in JP-A-54-136328, U.S. Pat. Nos. 4,267,262, 4,009,030 and 4,029,849, latex polymers obtained by the copolymerization of a small amount of a hydrophilic comonomer such as acrylic acid as disclosed in JP-A-54-128335, JP-A-56-69629, JP-A-57-6843 and U.S. Pat. Nos. 4,056,394, 4,061,496, 4,199,362, 4,250,243, 4,256,827 and 4,268,604, polymers containing lactone ring as disclosed in U.S. Pat. No. 4,229,516 and polymers as disclosed in JP-A-56-25735, JP-A-56-97346, JP-A-57-6842, EP-A-31957, EP-A-37724 and EP-A-48412.

Further, there can also be used compounds as described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patent Application (OLS) Nos. 1,622,936 and 2,162,277, and *Research Disclosure* No. 15162, Vol 151, (November 1976).

These timing layers may be used singly or in combination.

The timing layer made of these materials may comprise a development inhibitor and/or precursor thereof as disclosed in U.S. Pat. No. 4,009,029, West German Patent Application (OLS) Nos. 2,913,164 and 3,014,672, JP-A-54-155837 and JP-A-55-138745, a hydroquinone precursor as disclosed in U.S. Pat. No. 4,201,578 or other photographically useful additives or precursors thereof.

Further, an auxiliary neutralizing layer can be advantageously provided as a layer having a neutralizing function to minimize the change in the transfer density with time after processing as described in JP-A-63-168648 and JP-A-63-168649.

I) Others

Besides the layer having a neutralizing function, a back layer, protective layer, filter dye layer, etc. may be provided as a layer having an auxiliary function.

The back layer is provided to control curling or provide slipperiness. A filter dye may be incorporated in the back layer.

The protective layer is mainly used to inhibit the adhesion to the back side of the cover sheet or the adhesion to the protective layer of the photosensitive material when the photosensitive material is laminated on the cover sheet in a monosheet type photographic light-sensitive material.

A capturing mordant layer is adapted to capture dyes which have diffused to the alkaline processing composition side to inhibit the delay in the completion of image or the deterioration of sharpness. In general, a dye capturing layer is provided as an outermost layer of the cover sheet. The dye capturing layer comprises a polymer mordant incorporated in a hydrophilic colloid similarly to the foregoing dye image-receiving layer. For details, reference can be made to JP-A-1-198747 and JP-A-2-282253.

A dye may be incorporated in the cover sheet to control the sensitivity of the photosensitive layer. A filter dye may be directly incorporated in the support for the cover sheet or the layer having a neutralizing function. Further, it may be incorporated in the back layer, protective layer, capturing mordant layer or the like. Alternatively, it is provided as a single layer.

III. Alkaline Processing Composition

The processing composition to be used in the present invention is uniformly spreaded over the photosensitive element after the exposure of the photosensitive element so that the photosensitive layer is developed by components contained therein. To this end, the processing composition contains an alkali, a thickening agent, a developing agent, a development accelerator and development inhibitor for controlling the development, an oxidation inhibitor for inhibiting the deterioration of a developing agent, a gradation controller, etc.

The alkali must be strong enough to adjust the pH value of the solution at 12 to 14. Examples of such an alkali include hydroxide of alkaline metals (e.g., sodium hydroxide, potassium hydroxide, lithium hydroxide), phosphate of alkaline metals (e.g., potassium phosphate), guanidines, and hydroxide of quaternary amines (e.g., tetramethylammonium hydroxide). Preferred among these alkalis are potassium hydroxide and sodium hydroxide. Particularly preferred among these alkalis is potassium hydroxide.

The thickening agent is needed to uniformly spread the processing solutions or maintain sufficient adhesion between the photosensitive layer and the cover sheet. For example, alkaline metal salts of polyvinyl alcohol, hydroxyethylcellulose and carboxymethylcellulose may be used. The thickening agent is preferable thixotropic to prevent the processing solution from leaking from a rupturable vessel and cause the processing solution to uniformly spread over the photosensitive layer. Thus, hydroxyethylcellulose, sodium hydroxymethylcarboxylate and carboxymethylhydroxyethylcellulose may be used.

As a preferred developing agent there can be used any compound so far as it cross-oxidizes a dye image-forming substance or is oxidized without substantially causing stain. These developing agents may be used singly or in combination. These developing agent may be used in the form of precursors. These developing agents may be incorporated in a proper layer of the photosensitive element or in an alkaline processing solution. Specific examples of these developing agents include aminophenols and pyrazolidiones. Particularly preferred among these developing agents are pyrazolidinoes, which cause reduced stain.

Examples of such pyrazolidiones include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone and 1-p-tolyl-4-methyl-4-hydroxymethyl-3-pyrazolidinone.

Examples of the development accelerator include amine, amino acid and polyethylene glycol. Other examples of the development accelerator include benzyl alcohol and hydroxymethylbenzene.

As the development inhibitor there may be used an arbitrary compound. For the development of an auto positive emulsion combined with a nucleator, a triazole derivative is preferably used as a development inhibitor. In particular, a benzotriazole derivative is preferred.

As an oxidation inhibitor for inhibiting the deterioration of a developing agent there may be used any oxidation inhibitor having a reducing power high enough to inhibit the oxidation of a developing agent. A sulfite, particularly potassium sulfite, is desirable.

Preferred examples of the gradation adjustor include hydroquinone derivative and ascorbic acid derivative.

In order to enhance the ageing stability of the processing solution, it is preferred that a transition metal salt such as zinc nitrate be added. An aluminum salt is preferably added to provide a pH buffering capacity.

The processing solutions may optionally comprise a light-shielding agent incorporated therein. In particular, it is essential to provide the processing solutions with a light-shielding function in the case of an integrated type photographic light-sensitive material which is exposed to light through a transparent support.

As such a light-shielding agent there may be used carbon black or other pigment or dye. In the case where the processing solutions contain a white pigment and a dye image is observed on the processing solution layer thus spread as a background, a pH-sensitive dye is preferably used as a light-shielding agent.

Any of the photosensitive sheet, cover sheet and alkaline processing composition may comprise a development accelerator as disclosed in JP-A-62-215272 (pp. 72–91), a hardener as disclosed in the same patent (pp. 146–155), a surface active agent as disclosed in the same patent (pp. 201–210), a fluorine-containing compound as disclosed in the same patent (pp. 210–222), a thickening agent as disclosed in the same patent (pp. 225–227), an antistatic agent as disclosed in the same patent (pp. 227–230), a polymer latex as disclosed in the same patent (pp. 230–239), a matting agent as disclosed in the same patent (page 240), etc.

The present invention will be further described in the following examples, but the present invention should not be construed as being limited thereto.

EXAMPLE 1

The preparation of silver halide emulsions will be described hereinafter.

The following four silver halide emulsions (Emulsions A to C) and Emulsion D6 were prepared in accordance with the following process for the preparation of emulsion grains.

Preparation of Emulsion A (Octahedral Internal Latent Image Type Direct Positive Photographic Emulsion)

To 1,000 ml of an aqueous solution of gelatin containing 0.05 M of potassium bromide, 1 g of 3,6-dithia-1,8-octanediol, 0.05 mg of lead acetate and 60 g of deionized gelatin having a Ca content of not more than 100 ppm were added a 0.4 M aqueous solution of silver nitrate and a 0.4 M aqueous solution of potassium bromide by the controlled double jet process while the temperature thereof was being kept to 75° C. In this controlled double jet process, 300 ml of the aqueous solution of silver nitrate was added to the system in 40 minutes while the addition rate of the aqueous solution of potassium bromide being controlled such that pBr reached 1.60.

After the completion of the addition of these aqueous solutions, octahedral silver bromide crystal grains (hereinafter referred to as "core grain") having an average grain diameter (in sphere equivalence) of about 0.7 $\mu$m and a uniform grain size distribution were produced.

To the solution thus prepared were then added 1 mg of sodium thiosulfate and 3 ml out of an aqueous solution obtained by dissolving 90 mg of potassium tetrachloroaurate and 1.2 g of potassium bromide in 1,000 mg of water. The emulsion was then heated to a temperature of 75° C. for 80 minutes so that it was subjected to chemical sensitization. To the emulsion thus chemically sensitized was then added 0.15 M of potassium bromide. To the emulsion were then added a 0.9 M aqueous solution of silver nitrate and a 0.9 M aqueous solution of potassium bromide by the controlled double jet process while the temperature thereof was being kept to 75° C., in the same manner as in the preparation of the core grain. In this controlled double jet process, 670 ml of the aqueous solution of silver nitrate was added to the system in 70 minutes while the addition rate of the aqueous solution of potassium bromide being controlled such that pBr reached 1.30.

The emulsion thus obtained was then washed by an ordinary flocculation method. To the emulsion thus washed were then added the foregoing gelatin, 2-phenoxyethanol and methyl p-hydroxybenzoate to obtain octahedral silver bromide crystal grains (hereinafter referred to as "internal latent image type core/shell grains") having an average grain diameter (in sphere equivalence) of about 1.4 μm and a uniform grain size distribution.

To the internal latent image type core/shell emulsion thus obtained were then added 3 ml out of an aqueous solution obtained by dissolving 100 ml of sodium thiosulfate and 40 mg of sodium tetraborate in 1,000 ml of water. To the emulsion was then added 14 mg of a poly(N-vinylpyrrolidone). The emulsion was then heated to a temperature of 60° C. so that it was ripened. To the emulsion was then added 0.005 M of potassium bromide to prepare an octahedral internal latent image type direct positive photographic emulsion.

Preparation of Emulsion B (Octahedral Internal Latent Image Type Direct Positive Photographic Emulsion)

An octahedral internal latent image type direct positive photographic emulsion having an average grain diameter (in sphere equivalence) of about 1.0 μm and a uniform grain size distribution was prepared in the same manner as for Emulsion A except that the time during which the aqueous solution of silver nitrate and the aqueous solution of potassium bromide were added and the added amount of the additives were altered.

Preparation of Emulsion C (Octahedral Internal Latent Image Type Direct Positive Photographic Emulsion)

An octahedral internal latent type direct positive photographic emulsion having an average grain diameter (in sphere equivalence) of about 0.7 μm and a uniform grain size distribution was prepared in the same manner as for Emulsion A except that the time during which the aqueous solution of silver nitrate and the aqueous solution of potassium bromide were added and the added amount of the additives were altered.

Preparation of Emulsion D6 (Hexagonal Tabular Internal Latent Image Type Direct Positive Photographic Emulsion)

To 1.2 l of an aqueous solution of gelatin containing 0.05 M of potassium bromide and 0.7% by weight of gelatin having an average molecular weight of not more than 100,000 were simultaneously added a 1.4 M aqueous solution of silver nitrate containing the foregoing gelatin and a 2 M aqueous solution of potassium bromide with vigorous stirring by the double jet process at a rate of 33 ml per minute each. In this double jet process, the aqueous solution of gelatin was kept at a temperature of 30° C. To the emulsion was then added 300 ml of a gelatin solution containing 10% by weight of deionized gelatin having a Ca content of not more than 100 ppm. The emulsion was then heated to a temperature of 75° C.

To the emulsion was then added 40 ml of a 0.9 M aqueous solution of silver nitrate in 3 minutes. To the emulsion was then added a 25 wt. % aqueous ammonia. The emulsion was then ripened at a temperature of 75° C. After the completion of ripening, ammonia was neutralized. To the emulsion was then added 5 ml of lead acetate (in the form of aqueous solution). To the emulsion were then added a 1 M aqueous solution of silver nitrate and a 1 M aqueous solution of potassium bromide by the double jet process at an accelerated flow rate (the flow rate at the end of the addition was 6 times that at the beginning of the addition) while the pBr value thereof was being kept to 2.2. (The supplied amount of the aqueous solution of silver nitrate was 500 ml.)

The grains thus formed (hereinafter referred to as "core grains") were then washed by an ordinary flocculation method. To the emulsion were then added gelatin, 2-phenoxyethanol and methyl p-hydroxybenzoate to obtain 750 g of hexagonal tabular core grains which were then washed.

The hexagonal tabular core grains had an average diameter of 0.9 μm as calculated in terms of circle having an area corresponding to projected area and an average thickness of 0.20 μm. Hexagonal tabular grains accounted for 95% of all grains as calculated in terms of projected area.

To 200 g of the foregoing hexagonal tabular core emulsion as a seed crystal emulsion were then added 1,300 ml of water, 0.11 M of potassium bromide and 40 g of deionized gelatin. The emulsion was then heated to a temperature of 75° C. To the emulsion were then added 0.3 g of 3,6-dithia-1,8-octanediol, 10 mg of Compound 1-16, 2.4 ml out of an aqueous solution obtained by dissolving 90 mg of potassium tetrachloroaurate and 1.2 g of potassium bromide in 1,000 ml of water, and 15 mg of lead acetate (in the form of aqueous solution). The emulsion was then heated to a temperature of 75° C. for 180 minutes so that it was subjected to chemical sensitization. An external shell was then formed on the grains as follows. In some detail, to the core grains thus chemically sensitized were then added a 2 M aqueous solution of silver nitrate and a 2.5 M aqueous solution of potassium bromide by the double jet process at an accelerated flow rate (the flow rate at the end of the addition was 3 times that at the beginning of the addition) while the pBr value thereof was being kept to 2.2 by controlling the amount and rate at which the aqueous solution of potassium bromide was added, in the same manner as in the preparation of the core grain. (The supplied amount of the aqueous solution of silver nitrate was 810 ml.)

To the emulsion was then added a 0.3 M potassium bromide. The emulsion was then washed by an ordinary flocculation method. To the emulsion was then added gelatin. Thus, a hexagonal tabular internal latent image type core/shell emulsion was obtained. The hexagonal tabular grains had an average diameter of 2.5 μm as calculated in terms of circle having an area corresponding to projected area, an average thickness of 0.37 μm and an average volume size of 1.4 $(\mu m)^3$. Hexagonal tabular grains accounted for 88% of all grains as calculated in terms of projected area.

To the hexagonal tabular internal latent image type core/shell emulsion thus obtained were then added 15 ml out of an aqueous solution obtained by dissolving 100 mg of sodium thiosulfate and 40 mg of sodium tetraborate in 1,000 ml of water. To the emulsion was then added 20 mg of a poly(N-vinylpyrrolidone). The emulsion was then heated to a temperature of 60° C. for 100 minutes so that the surface of the grains were subjected to chemical sensitization. Thus, a hexagonal tabular internal latent image type direct positive photographic emulsion was prepared.

Emulsions D1 to D5 were prepared in the same manner as for Emulsion D6 except that the amount and rate at which the aqueous solution of potassium bromide was added to form an external cell were altered and the added amount of the compound represented by the formula (A), (B) or (C) was altered.

TABLE 1

Emulsions prepared

| Emulsion No. | a/μm | b/μm | pBr | Compound of the formula (A), (B) or (C) Compound No. | Added amount |
|---|---|---|---|---|---|
| D1 (comparison) | 1.556 | 0.0350 | 1.25 | — | — |
| D2 (present invention) | 0.595 | 0.0925 | 3.29 | — | — |
| D3 (present invention) | 0.792 | 0.0825 | 2.20 | — | — |
| D4 (comparison) | 1.556 | 0.0350 | 1.25 | 1–16 | 10 mg |
| D5 (present invention) | 0.595 | 0.0925 | 3.29 | 1–16 | 10 mg |
| D6 (present invention) | 0.792 | 0.0825 | 2.20 | 1–16 | 10 mg |

a: thickness along the main plane;
b: thickness perpendicular to the main plane

A comparative photosensitive element (Sample 101) having the constitution set forth in Table 2 was prepared from these emulsions.

TABLE 2

Constitution of comparative photosensitive element 101

| Layer No. | Layer name | Additive | Coated amount (g/m$^2$) |
|---|---|---|---|
| 24th layer | Protective layer | Gelatin | 0.26 |
| | | Additive (1) | 0.08 |
| | | Matting agent (1) | 0.05 |
| | | Hardener (1) | 0.07 |
| 23th layer | Ultraviolet absorbing layer | Gelatin | 0.48 |
| | | Ultraviolet absorbent (1) | 0.09 |
| | | Ultraviolet absorbent (2) | 0.08 |
| | | Additive (3) | 0.08 |
| 22nd layer | Blue-sensitive layer (high sensitivity) | Emulsion A | 0.06 (in silver equivalence) |
| | | Sensitizing dye (4) | $1.3 \times 10^{-3}$ |
| | | Sensitizing dye (5) | $3.3 \times 10^{-4}$ |
| | | Nucleator (1) | $8.0 \times 10^{-6}$ |
| | | Additive (2) | $3.6 \times 10^{-2}$ |
| | | Additive (4) | $9.4 \times 10^{-4}$ |
| | | Additive (5) | $6.6 \times 10^{-6}$ |
| | | Gelatin | 0.90 |
| 21st layer | Blue-sensitive layer (middle sensitivity) | Emulsion B | 0.11 (in silver equivalence) |
| | | Sensitizing dye (4) | $3.3 \times 10^{-4}$ |
| | | Sensitizing dye (5) | $8.5 \times 10^{-5}$ |
| | | Nucleator (1) | $2.0 \times 10^{-6}$ |
| | | Additive (2) | $9.2 \times 10^{-3}$ |
| | | Additive (4) | $2.4 \times 10^{-4}$ |
| | | Additive (5) | $1.7 \times 10^{-6}$ |
| | | Gelatin | 0.20 |
| 20th layer | Blue-sensitive layer (low sensitivity) | Emulsion C | 0.11 (in silver equivalence) |
| | | Sensitizing dye (4) | $4.8 \times 10^{-4}$ |
| | | Sensitizing dye (5) | $1.2 \times 10^{-4}$ |
| | | Nucleator (1) | $2.9 \times 10^{-6}$ |
| | | Additive (2) | $1.3 \times 10^{-2}$ |
| | | Additive (4) | $3.5 \times 10^{-4}$ |
| | | Additive (5) | $2.4 \times 10^{-6}$ |
| | | Gelatin | 0.20 |

TABLE 2-continued

Constitution of comparative photosensitive element 101

| Layer No. | Layer name | Additive | Coated amount (g/m$^2$) |
|---|---|---|---|
| 19th layer | White reflective layer | Titanium dioxide | 1.10 |
| | | Additive (1) | $4.2 \times 10^{-2}$ |
| | | Gelatin | 0.29 |
| 18th layer | Yellow coloring material | Yellow dye-releasing compound (1) | 0.47 |
| | | High boiling organic solvent (1) | $9.4 \times 10^{-2}$ |
| | | Additive (1) | $1.4 \times 10^{-2}$ |
| | | Gelatin | 0.42 |
| 17th layer | Interlayer | Gelatin | 0.23 |
| | | Matting agent (1) | 0.10 |
| 16th layer | Color mixture preventive layer | Additive (1) | 0.90 |
| | | Polymethyl methacrylate | 0.25 |
| | | Gelatin | 0.51 |
| 15th layer | Green-sensitive layer (high sensitivity) | Emulsion A | 0.54 (in silver equivalence) |
| | | Sensitizing dye (2) | $1.2 \times 10^{-3}$ |
| | | Sensitizing dye (3) | $1.0 \times 10^{-3}$ |
| | | Nucleator (1) | $3.9 \times 10^{-6}$ |
| | | Additive (2) | $7.2 \times 10^{-2}$ |
| | | Additive (4) | $2.6 \times 10^{-3}$ |
| | | Additive (5) | $5.0 \times 10^{-6}$ |
| | | Gelatin | 1.10 |
| 14th layer | Green-sensitive layer (middle sensitivity) | Emulsion B | 0.11 (in silver equivalence) |
| | | Sensitizing dye (2) | $7.2 \times 10^{-5}$ |
| | | Sensitizing dye (3) | $5.6 \times 10^{-5}$ |
| | | Nucleator (1) | $1.2 \times 10^{-6}$ |
| | | Additive (2) | $1.6 \times 10^{-2}$ |
| | | Additive (4) | $2.0 \times 10^{-4}$ |
| | | Gelatin | 0.23 |
| 13th layer | Green-sensitive layer (low sensitivity) | Emulsion C | 0.11 (in silver equivalence) |
| | | Sensitizing dye (2) | $1.0 \times 10^{-4}$ |
| | | Sensitizing dye (3) | $8.1 \times 10^{-5}$ |
| | | Nucleator (1) | $1.7 \times 10^{-6}$ |
| | | Additive (2) | $2.3 \times 10^{-2}$ |
| | | Additive (4) | $2.8 \times 10^{-4}$ |
| | | Gelatin | 0.23 |
| 12th layer | White reflective layer | Titanium dioxide | 1.60 |
| | | Additive (1) | $6.3 \times 10^{-2}$ |
| | | Gelatin | 0.44 |
| 11th layer | Magenta coloring material | Magenta dye-releasing compound (1) | 0.35 |
| | | High boiling organic Solvent (1) | $7.0 \times 10^{-2}$ |
| | | Additive (1) | 1.7 × 102 |
| | | Gelatin | 0.20 |
| 10th layer | Interlayer | Gelatin | 0.29 |
| | | Matting agent (1) | 0.06 |
| 9th layer | Color mixture preventive layer | Additive (1) | 1.70 |
| | | Polymethyl methacrylate | 0.43 |
| | | Gelatin | 0.86 |
| 8th layer | Red-sensitive layer (high sensitivity | Emulsion A | 0.42 (in silver equivalence) |
| | | Additive (6) | $9.0 \times 10^{-5}$ |
| | | Sensitizing dye (1) | $1.1 \times 10^{-3}$ |
| | | Nucleator (1) | $8.5 \times 10^{-6}$ |
| | | Additive (2) | $3.9 \times 10^{-2}$ |
| | | Additive (4) | $2.0 \times 10^{-3}$ |
| | | Gelatin | 0.43 |
| 7th layer | Red-sensitive layer (middle sensitivity) | Emulsion B | 0.15 (in silver equivalence) |
| | | Sensitizing dye (1) | $1.5 \times 10^{-4}$ |
| | | Nucleator (1) | $6.9 \times 10^{-6}$ |
| | | Additive (2) | $1.8 \times 10^{-2}$ |
| | | Additive (4) | $5.6 \times 10^{-4}$ |
| | | Gelatin | 0.53 |

TABLE 2-continued

Constitution of comparative photosensitive element 101

| Layer No. | Layer name | Additive | Coated amount (g/m$^2$) |
|---|---|---|---|
| 6th layer | Red-sensitive layer (low sensitivity) | Emulsion C | 0.15 (in silver equivalence) |
| | | Sensitizing dye (1) | $2.1 \times 10^{-4}$ |
| | | Nucleator (1) | $9.9 \times 10^{-6}$ |
| | | Additive (2) | $2.5 \times 10^{-2}$ |
| | | Additive (4) | $8.0 \times 10^{-4}$ |
| | | Gelatin | 0.53 |
| 5th layer | White reflective layer | Titanium dioxide | 3.40 |
| | | Gelatin | 0.84 |
| 4th layer | Cyan coloring material | Cyan dye-releasing compound (1) | 0.36 |
| | | High boiling organic solvent (1) | $3.0 \times 10^{-2}$ |
| | | Additive (2) | $3.0 \times 10^{-2}$ |
| | | Gelatin | 0.4 |
| 3rd layer | Opaque layer | Carbon black | 1.70 |
| | | Gelatin | 1.70 |
| 2nd layer | White reflective layer | Titanium dioxide | 22.00 |
| | | Gelatin | 2.75 |
| 1st layer | Image-receiving layer | Polymer mordant (1) | 3.00 |
| | | Gelatin | 3.00 |
| | Support (polyethylene terephthalate: 120 μm) | | |

Polymer mordant (1)

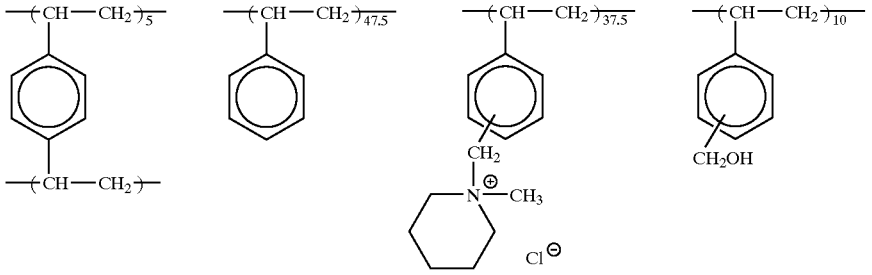

Ultraviolet absorbent (1)

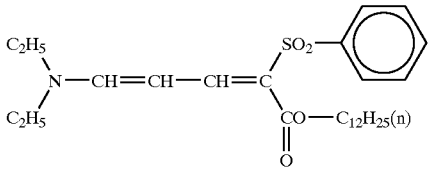

Ultraviolet absorbent (2)

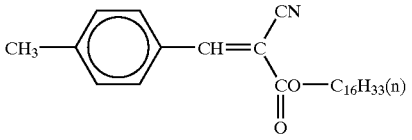

Matting agent (1)

Spherical latex of polymethyl methacrylate (average grain diameter: 4 μm)

Cyan dye-releasing compound (1)

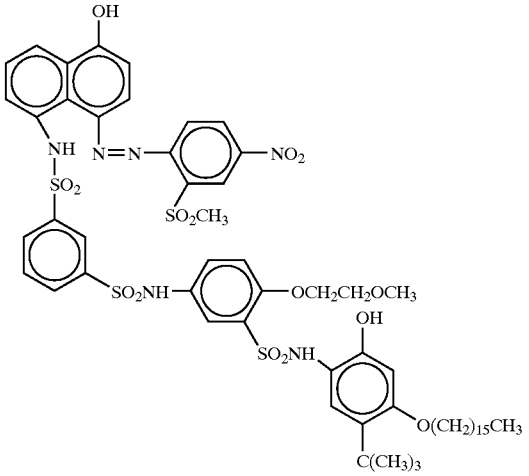

-continued
Magenta dye-releasing compound (1)
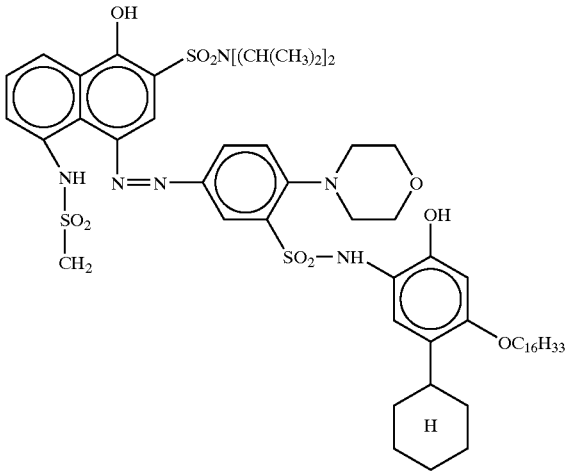
Yellow dye-releasing compound (1)
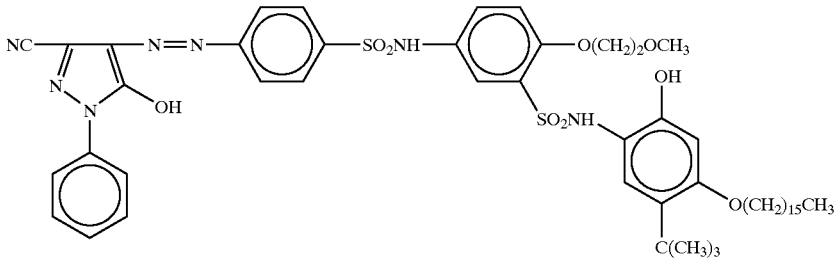
Additive (1)
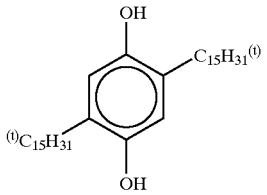
Additive (2)
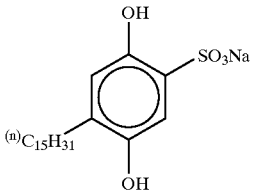
Additive (3)
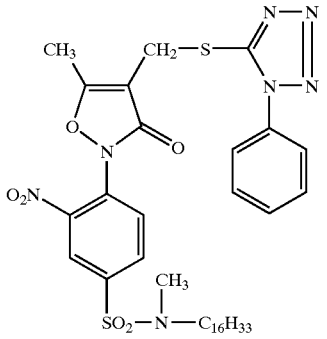
Additive (4)
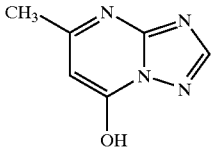
Additive (5)
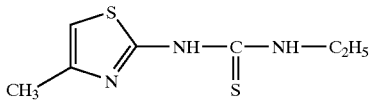
Additive (6)
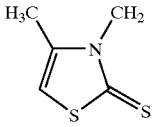
High boiling organic solvent (1)
Tricyclohexyl phosphate
Hardener (1)
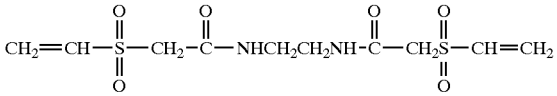

-continued

Nucleator (1)

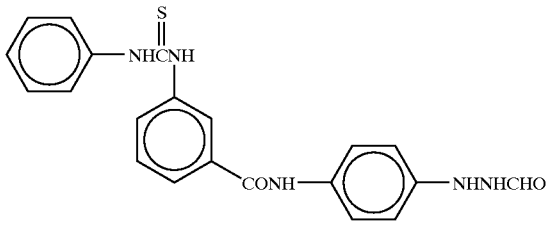

Sensitizing dye (1)

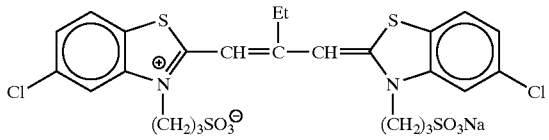

Sensitizing dye (2)

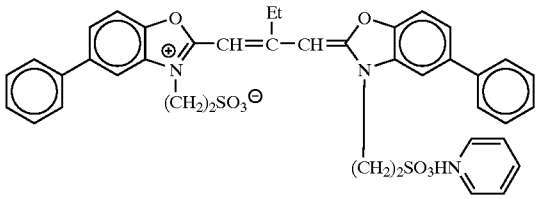

Sensitizing dye (3)

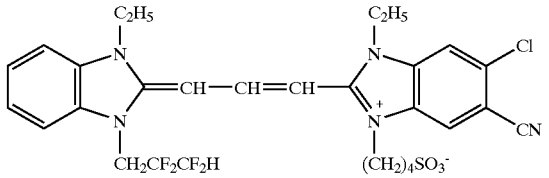

Sensitizing dye (4)

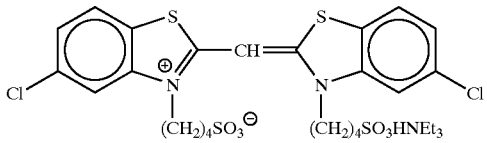

Sensitizing dye (5)

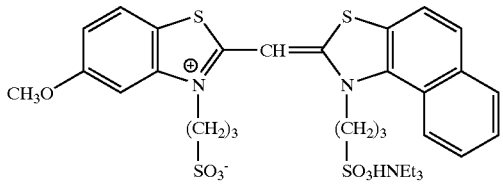

Samples 201 to 206 were prepared in the same manner as above except that the emulsions to be incorporated in the 8th, 15th and 22nd layers were replaced by Emulsions D1 to D6, respectively, as set forth in Table 3.

TABLE 3

| | Emulsions used | | |
|---|---|---|---|
| Sample No. | 8th layer | 15th layer | 22nd layer |
| 101 (comparison) | A | A | A |
| 201 (comparison) | D1 | D1 | D1 |
| 202 (present invention) | D2 | D2 | D2 |
| 203 (present invention) | D3 | D3 | D3 |
| 204 (comparison) | D4 | D4 | D4 |
| 205 (present invention) | D5 | D5 | D5 |
| 206 (present invention) | D6 | D6 | D6 |

The cover sheet was prepared as follows.

In some detail, the following layers were applied to a gelatin-undercoated transparent polyethylene terephthalate support containing a light piping inhibiting dye.

(1) A neutralizing layer containing 10.4 g/m$^2$ of an acrylic acid-butyl acrylate (8:2 by mol) having an average molecular weight of 50,000 and 0.1 g/m$^2$ of 1,4-bis(2,3-epoxypropoxy)butane;

(2) A neutralization timing layer containing 4.3 g/m$^2$ of an acetyl cellulose having an acetylation degree of 51% and 0.2 g/m$^2$ of a poly(methylvinylether-comonomethyl maleate);

(3) A layer comprising a 6:4 blend (by solid content) of a polymer latex obtained by emulsion polymerization of styrene, butyl acrylate, acrylic acid and N-methylolacrylamide in a weight proportion of 49.7/42.3/4/4 and a polymer latex obtained by emulsion polymerization of methyl methacrylate, acrylic acid and N-methylolacrylamide in a weight proportion of 93/3/4, the total solid content of which being 2.5 g/m$^2$; and (4) A layer containing 1 g/m$^2$ of gelatin.

The alkaline processing composition was prepared as follows.

In some detail, a pressure-rupturable vessel was filled with 0.8 g of a processing solution having the following composition.

| | |
|---|---|
| 1-p-Tollyl-4-hydroxymethyl-4-methyl-3-pyrazolidone | 10.0 g |
| Methylhydroquinone | 0.18 g |
| 5-Methylbenzotriazole | 3.0 g |
| Anhydrous sodium sulfite | 0.2 g |
| Benzyl alcohol | 1.5 ml |
| Sodium salt of carboxymethylcellulose | 58 g |
| Carbon black | 150 g |
| 28% Aqueous solution of potassium hydroxide | 200 ml |
| Water | 680 ml |

The foregoing photosensitive elements 101 and 201 to 206 were each exposed to light on the emulsion side through a gray continuous wedge. These photosensitive elements were each laminated on the foregoing cover sheet. The foregoing processing solution was then spread between the photosensitive element and the cover sheet to a thickness of 75 $\mu$m by means of a pressure roller. The exposure was effected for 1/100" and for $10^{-4}$" at an intensity such that a constant exposure was obtained. The processing was effected at a temperature of 25° C. After 10 minutes, these samples were each measured for transfer density by means of a color densitometer.

The results are set forth in Table 4. The maximum density, minimum density, reversal sensitivity and negative sensitivity set forth in the table were determined as follows. In some detail, characteristic curves are plotted with the logarithm of exposure as abscissa and color density as ordinate. The color density at the unexposed area is defined as maximum density. The color density at sufficiently exposed area is defined as minimum density. The sensitivity which gives the intermediate density between the maximum density and the minimum density in 1/100", exposure is defined as middle sensitivity. The sensitivity which gives a density of minimum density plus 1.0 in $10^{-4}$" exposure is defined as negative sensitivity.

in accordance with the procedure as described in JP-A-U-63-150939 (The term "JP-A-U" as used herein means an "unexamined published Japanese utility model application"). These samples were each then examined in the same manner as in Example 1 using this camera.

The results are the same as in Example 1. As a result, the effect of the present invention was confirmed.

TABLE 4

| | Maximum density, minimum density, middle sensitivity, negative sensitivity | | | | | | | | | | | |
|---|---|---|---|---|---|---|---|---|---|---|---|---|
| | Maximum density | | | Minimum density | | | Middle sensitivity | | | Negative sensitivity | | |
| Sample No. | Y | M | C | Y | M | C | Y | M | C | Y | M | C |
| 101 (comparison) | 2.10 | 2.30 | 2.40 | 0.17 | 0.16 | 0.24 | 100 | 100 | 100 | 100 | 100 | 100 |
| 201 (comparison) | 2.15 | 2.33 | 2.45 | 0.17 | 0.16 | 0.24 | 105 | 130 | 146 | 115 | 125 | 130 |
| 202 (present invention) | 2.13 | 2.32 | 2.42 | 0.17 | 0.17 | 0.25 | 110 | 128 | 148 | 83 | 84 | 86 |
| 203 (present invention) | 2.14 | 2.35 | 2.44 | 0.17 | 0.16 | 0.26 | 107 | 131 | 152 | 94 | 92 | 94 |
| 204 (comparison) | 2.14 | 2.35 | 2.45 | 0.16 | 0.17 | 0.25 | 108 | 133 | 155 | 96 | 101 | 105 |
| 205 (present invention) | 2.16 | 2.36 | 2.46 | 0.17 | 0.16 | 0.24 | 116 | 133 | 154 | 72 | 70 | 73 |
| 206 (present invention) | 2.14 | 2.32 | 2.44 | 0.17 | 0.17 | 0.25 | 115 | 136 | 158 | 79 | 74 | 78 |

It can be seen in Table 4 that Sample 203 exhibits improved negative sensitivity with maintaining high middle sensitivity, although Sample 201 undesirably exhibits high negative sensitivity. It can also be seen that Sample 203 exhibits a reduced negative sensitivity while maintaining a sufficient middle sensitivity with respect to Sample 101.

Further, the comparison between Sample 202 and Sample 205 and between Sample 203 and Sample 206 shows the effects of the compounds of the present invention represented by the formula (A), (B) or (C).

EXAMPLE 2

A photosensitive element was prepared in the same manner as for the comparative photosensitive element (Sample 101) except that the emulsions to be incorporated in the 8th layer, 15th layer and 22nd layer were replaced by the emulsions to be incorporated in the 4th layer, 7th layer and 12th layer of Sample No. 1 of Example 1 of JP-A-2-90145, respectively. The photosensitive element was then examined in the same manner as in Example 1.

The results are the same as in Example 1. As a result, the effect of the present invention was confirmed.

EXAMPLE 3

A photosensitive element was prepared in the same manner as for the comparative photosensitive element (Sample 101) except that the emulsions to be incorporated in the 8th layer, 15th layer and 22nd layer were replaced by the emulsions to be incorporated in the 3rd layer, 5th layer and 9th layer of Sample No. 106 of Example 1 of JP-A-3-189643, respectively. The photosensitive element was then examined in the same manner as in Example 1.

The results are the same as in Example 1. As a result, the effect of the present invention was confirmed.

EXAMPLE 4

Samples 101 to 206 prepared in Example 1 were each worked into a form that can be mounted in an instant camera

EXAMPLE 5

The preparation of silver halide emulsions will be described hereinafter.

The following 11 silver halide emulsions (Emulsions A1 to A3, B, C, D1, D2, E, F, G, H) were prepared by the following process for the preparation of emulsion grains.

Preparation of Emulsion A1 (Octahedral Internal Latent Image Type Direct Positive Photographic Emulsion)

Emulsion A1 was prepared by the same preparation process as used for Emulsion A of Example 1.

Preparation of Emulsion A2 (Octahedral Internal Latent Image Type Direct Positive Photographic Emulsion)

An octahedral internal latent image type direct positive photographic emulsion was prepared in the same manner as for Emulsion A1 except that the step of preparing core grains comprises only the use of the core seed crystal emulsion E (octahedral silver bromide emulsion having an average grain diameter (in sphere equivalence) of about 0.7 $\mu$m and a uniform grain size distribution).

In some detail, distilled water was added to the core seed crystal emulsion E containing 0.12 M of silver bromide to make 1,600 ml. The emulsion was then heated to a temperature of 75° C. To the emulsion were then added 1 g of 3,6-dithia-1,8-octanediol and 0.05 mg of lead acetate. The emulsion was then adjusted to pBr 1.60 with potassium bromide. The emulsion was then subjected to chemical sensitization and other treatments in the same manner as for Emulsion A1.

Preparation of Emulsion A3 (Octahedral Internal Latent Image Type Direct Positive Photographic Emulsion)

An octahedral internal latent image type direct positive photographic emulsion was prepared in the same manner as for Emulsion A2 except that the core seed crystal emulsion E was replaced by the core seed crystal emulsion F.

Preparation of Emulsion B (Octahedral Internal Latent Image Type Direct Positive Photographic Emulsion)

Emulsion B was prepared in the same manner as for Emulsion B of Example 1.

Preparation of Emulsion C (Octahedral Internal Latent Image Type Direct Positive Photographic Emulsion)

Emulsion C was prepared in the same manner as for Emulsion C of Example 1.

Preparation of Emulsion D1 (Hexagonal Tabular Internal Latent Image Type Direct Positive Photographic Emulsion)

To 200 g of the core seed crystal emulsion G were then added 0.11 M of potassium bromide and 40 g of deionized gelatin. Distilled water was then added to the emulsion to make 1,300 ml. The emulsion was then heated to a temperature of 75° C. To the emulsion were then added 0.3 g of 3,6-dithia-1,8-octanediol, 10 mg of sodium benzenethiosulfate, 2.4 ml out of an aqueous solution obtained by dissolving 90 mg of potassium tetrachloroaurate and 1.2 g of potassium bromide in 1,000 ml of water, and 15 mg of lead acetate (in the form of aqueous solution). The emulsion was then heated to a temperature of 75° C. for 180 minutes so that it was subjected to chemical sensitization. An external shell was then formed on the grains as follows. In some detail, to the core grains thus chemically sensitized were then added a 2 M aqueous solution of silver nitrate and a 2.5 M aqueous solution of potassium bromide by the double jet process at an accelerated flow rate (the flow rate at the end of the addition was 3 times that at the beginning of the addition) while the pBr value thereof was being kept to 2.2 by controlling the amount and rate at which the aqueous solution of potassium bromide was added. (The supplied amount of the aqueous solution of silver nitrate was 810 ml.)

To the emulsion was then added a 0.3 M potassium bromide. The emulsion was then washed by an ordinary flocculation method. To the emulsion was then added gelatin. Thus, a hexagonal tabular internal latent image type core/shell emulsion was obtained. The hexagonal tabular grains had an average diameter of 2.5 $\mu$m as calculated in terms of circle having an area corresponding to projected area, an average thickness of 0.37 $\mu$m and an average volume size of 1.4 $(\mu m)^3$. Hexagonal tabular grains accounted for 88% of all grains as calculated in terms of projected area.

To the hexagonal tabular internal latent image type core/shell emulsion thus obtained were then added 15 ml out of an aqueous solution obtained by dissolving 100 mg of sodium thiosulfate and 40 mg of sodium tetraborate in 1,000 ml of water. To the emulsion was then added 20 mg of a poly(N-vinylpyrrolidone). The emulsion was then heated to a temperature of 60° C. for 100 minutes so that the surface of the grains were subjected to chemical sensitization. Thus, a hexagonal tabular internal latent image type direct positive photographic emulsion was prepared.

Preparation of Emulsion D2 (Hexagonal Tabular Internal Latent Image Type Direct Positive Photographic Emulsion)

A hexagonal tabular internal latent image type direct positive photographic emulsion was prepared in the same manner as for Emulsion D1 except that the core seed crystal emulsion G was replaced by the core seed crystal emulsion H.

Preparation of Emulsion E (Octahedral Core Seed Crystal Emulsion)

To 1,000 ml of an aqueous solution of gelatin containing 0.05 M of potassium bromide, 1 g of 3,6-dithia-1,8-octanediol, 0.05 mg of lead acetate and 60 g of deionized gelatin having a Ca content of not more than 100 ppm were added a 0.7 M aqueous solution of silver nitrate and a 0.7 M aqueous solution of potassium bromide by the controlled double jet process while the temperature thereof was being kept to 75° C. In this controlled double jet process, 830 ml of the aqueous solution of silver nitrate was added to the system in 40 minutes while the addition rate of the aqueous solution of potassium bromide being controlled such that pBr reached 1.60.

The emulsion thus obtained was then washed by an ordinary flocculation method. To the emulsion thus washed were then added gelatin, 2-phenoxyethanol and methyl p-hydroxybenzoate to obtain 750 g of an octahedral core seed crystal emulsion.

The octahedral core seed crystal emulsion grains thus obtained (hereinafter referred to as "core grains") were octahedral silver bromide crystals having an average grain diameter (in sphere equivalence) of about 0.7 $\mu$m and a uniform grain size distribution.

Preparation of Emulsion F (Octahedral Core Seed Crystal Emulsion)

An octahedral core seed crystal emulsion was prepared in the same manner as for Emulsion E except that the addition of methyl p-hydroxybenzoate was followed by the addition of 0.4 mg of Compound 1-16 and heating at a temperature of 50° C. for 40 minutes.

Preparation of Emulsion G (Hexagonal Tabular Core Seed Crystal Emulsion)

To 1.2 l of an aqueous solution of gelatin containing 0.05 M of potassium bromide and 0.7% by weight of gelatin having an average molecular weight of not more than 100,000 were simultaneously added a 1.4 M aqueous solution of silver nitrate containing the foregoing gelatin and a 2 M aqueous solution of potassium bromide with vigorous stirring by the double jet process at a rate of 33 mg per minute each. In this double jet process, the aqueous solution of gelatin was kept at a temperature of 30° C. To the emulsion was then added 300 ml of a gelatin solution containing 10% by weight of deionized gelatin having a Ca content of not more than 100 ppm. The emulsion was then heated to a temperature of 75° C.

To the emulsion was then added 40 mg of a 0.9 M aqueous solution of silver nitrate in 3 minutes. To the emulsion was then added a 25 wt. % aqueous ammonia. The emulsion was then ripened at a temperature of 75° C. After the completion of ripening, ammonia was neutralized. To the emulsion was then added 5 mg of lead acetate (in the form of aqueous solution). To the emulsion were then added a 1 M aqueous solution of silver nitrate and a 1 M aqueous solution of potassium bromide by the double jet process at an accelerated flow rate (the flow rate at the end of the addition was 6 times that at the beginning of the addition) while the pBr value thereof was being kept to 2.2. (The supplied amount of the aqueous solution of silver nitrate was 500 ml.)

The grains thus formed were then washed by an ordinary flocculation method. To the emulsion were then added gelatin, 2-phenoxyethanol and methyl p-hydroxybenzoate to obtain 750 g of a hexagonal tabular core seed crystal emulsion.

The hexagonal tabular core seed crystal emulsion thus obtained had an average diameter of 0.9 $\mu$m as calculated in terms of circle having an area corresponding to projected area and an average thickness of 0.20 $\mu$m. Hexagonal tabular grains accounted for 95% of all grains as calculated in terms of projected area.

Preparation of Emulsion H (Hexagonal Tabular Core Seed Crystal Emulsion)

A hexagonal tabular core seed crystal emulsion was prepared in the same manner as for Emulsion G except that the addition of methyl p-hydroxybenzoate was followed by the addition of 0.4 mg of Compound 1-16 and heating at a temperature of 50° C. for 40 minutes.

In the foregoing emulsion preparation processes, 20 batches of Emulsions A1, A2, A3, D1 and D2 were prepared (Emulsions A1-1 to A1-20, Emulsions A2-1 to A2-20, Emulsions A3-1 to A3-20, Emulsions D1-1 to D1-20 and Emulsions D2-1 to D2-20). For the preparation of Emulsions A2, A3, D1 and D2, which comprised a seed crystal emulsion, there were prepared 6 batches of the seed crystal emulsions E, F, G and H which were then used in necessary amounts.

A comparative photosensitive element (Sample 301) was prepared from these emulsions in the same manner as set forth in Table 2 except that Emulsion A to be incorporated in the 8th layer, 15th layer and 22nd layer was replaced by the foregoing Emulsion A1-1, Emulsion B to be incorporated in the 7th layer, 14th layer and 21st layer was replaced by the foregoing Emulsion B, and Emulsion C to be incorporated in the 6th layer, 13th layer and 20th layer was replaced by the foregoing Emulsion C.

Samples 302 to 320 were then prepared in the same manner as for Sample 301 except that the emulsions to be incorporated in the 8th layer, 15th layer and 22nd layer were replaced by Emulsions A1-2 to A1-20. Samples 321 to 340 were prepared in the same manner as for Sample 301 except that the emulsions to be incorporated in the 8th layer, 15th layer and 22nd layer were replaced by Emulsions A2-1 to A2-20. Samples 341 to 360 were prepared in the same manner as for Sample 301 except that the emulsions to be incorporated in the 8th layer, 15th layer and 22nd layer were replaced by Emulsions A3-1 to A3-20. Samples 361 to 380 were prepared in the same manner as for Sample 301 except that the emulsions to be incorporated in the 8-th layer, 15th layer and 22nd layer were replaced by Emulsions D1-1 to D1-20. Samples 381 to 400 were prepared in the same manner as for Sample 301 except that the emulsions to be incorporated in the 8th layer, 15th layer and 22nd layer were replaced by Emulsions D2-1 to D2-20. (In each of these samples, the emulsions to be incorporated in the 8th layer, 15th layer and 22nd layer were simultaneously replaced by the same emulsion)

Samples 301 to 320 were prepared to show the reproducibility of Emulsion A1. Samples 321 to 340 were prepared to show the reproducibility of Emulsion A2. Samples 341 to 360 were prepared to show the reproducibility of Emulsion A3. Samples 361 to 380 were prepared to show the reproducibility of Emulsion D1. Samples 381 to 400 were prepared to show the reproducibility of Emulsion D2. The constitution of these samples is set forth in Table 5.

TABLE 5

| Sample No. | | Emulsions used 8th layer | 15th layer | 22nd layer |
|---|---|---|---|---|
| 301 | Comparative Example | Emulsion A1-1 | Emulsion A1-1 | Emulsion A1-1 |
| . | | . | . | . |
| . | | . | . | . |
| . | | . | . | . |
| 320 | | Emulsion A1-20 | Emulsion A1-20 | Emulsion A1-20 |
| 321 | Present Invention | Emulsion A2-1 | Emulsion A2-1 | Emulsion A2-1 |
| . | | . | . | . |
| . | | . | . | . |
| . | | . | . | . |
| 340 | | Emulsion A2-20 | Emulsion A2-20 | Emulsion A2-20 |
| 341 | Present Invention | Emulsion A3-1 | Emulsion A3-1 | Emulsion A3-1 |
| . | | . | . | . |
| . | | . | . | . |
| . | | . | . | . |

TABLE 5-continued

| Sample No. | | Emulsions used 8th layer | 15th layer | 22nd layer |
|---|---|---|---|---|
| 360 | | Emulsion A3-20 | Emulsion A3-20 | Emulsion A3-20 |
| 361 | Present Invention | Emulsion D1-1 | Emulsion D1-1 | Emulsion D1-1 |
| . | | . | . | . |
| . | | . | . | . |
| . | | . | . | . |
| 380 | | Emulsion D1-20 | Emulsion D1-20 | Emulsion D1-20 |
| 381 | Present Invention | Emulsion D2-1 | Emulsion D2-1 | Emulsion D2-1 |
| . | | . | . | . |
| . | | . | . | . |
| . | | . | . | . |
| 400 | | Emulsion D2-20 | Emulsion D2-20 | Emulsion D2-20 |

The cover sheet was prepared in the same manner as in Example 1.

The alkaline processing composition was prepared in the same manner as in Example 1.

The foregoing photosensitive elements 301 to 400 were each exposed to light on the emulsion side through a gray continuous wedge. These photosensitive elements were each laminated on the foregoing cover sheet. The foregoing processing solution was then spread between the photosensitive element and the cover sheet to a thickness of 75 $\mu$m by means of a pressure roller. The exposure was effected for 1/100" at an intensity such that a constant exposure was obtained. The processing was effected at a temperature of 25° C. After 10 minutes, these samples were each measured for transfer density by means of a color densitometer and evaluated for maximum density, minimum density and sensitivity.

The maximum density, minimum density and sensitivity were defined as follows. In some detail, characteristic curves are plotted with the logarithm of the reciprocal of exposure as abscissa and color density as ordinate. The color density at the unexposed area is defined as maximum density. The logarithm of the reciprocal of the exposure E (Log 1/E) which gives a density of (maximum density+minimum density)/2 relative to that of the reference sample (Sample 301) is defined as sensitivity.

The average value and standard deviation of maximum density, minimum density and sensitivity of 20 batches of Samples 301 to 320, Samples 321 to 340, Samples 341 to 360, Samples 361 to 380 or Samples 381 to 400 were then calculated. The results are set forth in Tables 6 and 7.

TABLE 6

Average value of maximum density, minimum density and sensitivity

| Sample No. | Maximum density (25° C.) | | | Minimum density (25° C.) | | | Relative sensitivity (25° C.) | | |
|---|---|---|---|---|---|---|---|---|---|
| | Y | M | C | Y | M | C | Y | M | C |
| 301–320 (comparative) | 2.00 | 2.20 | 2.30 | 0.17 | 0.16 | 0.24 | 1.02 | 1.00 | 1.01 |
| 321–340 (present invention) | 2.02 | 2.20 | 2.28 | 0.17 | 0.15 | 0.23 | 1.03 | 1.01 | 1.01 |
| 341–360 (present invention) | 2.07 | 2.26 | 2.37 | 0.16 | 0.16 | 0.24 | 1.03 | 1.02 | 1.02 |
| 361–380 (present invention) | 2.11 | 2.30 | 2.40 | 0.16 | 0.16 | 0.23 | 1.13 | 1.11 | 1.11 |
| 381–400 (present invention) | 2.15 | 2.36 | 2.43 | 0.16 | 0.15 | 0.23 | 1.16 | 1.14 | 1.13 |

TABLE 7

Standard deviation of maximum density, minimum density and sensitivity

| Sample No. | Maximum density (25° C.) | | | Minimum density (25° C.) | | | Relative sensitivity (25° C.) | | |
|---|---|---|---|---|---|---|---|---|---|
| | Y | M | C | Y | M | C | Y | M | C |
| 301–320 (comparative) | 0.13 | 0.13 | 0.12 | 0.007 | 0.007 | 0.007 | 0.11 | 0.11 | 0.12 |
| 321–340 (present invention) | 0.05 | 0.06 | 0.06 | 0.006 | 0.006 | 0.007 | 0.04 | 0.04 | 0.04 |
| 341–360 (present invention) | 0.03 | 0.03 | 0.04 | 0.006 | 0.005 | 0.006 | 0.02 | 0.02 | 0.03 |
| 361–380 (present invention) | 0.06 | 0.07 | 0.07 | 0.006 | 0.006 | 0.006 | 0.04 | 0.04 | 0.04 |
| 381–400 (present invention) | 0.03 | 0.03 | 0.03 | 0.006 | 0.005 | 0.006 | 0.03 | 0.02 | 0.03 |

It can be seen in these tables that Samples 321 to 340, Samples 341 to 360, Samples 361 to 380 and Samples 381 to 400, which are according to the present invention, exhibit a small standard deviation of maximum density, minimum density and sensitivity and a good reproducibility of Emulsions A2, A3, D1 and D2. It can also be seen that these effects can be exerted particularly with Samples 341 to 360 and Samples 381 to 400, which are made of Emulsions A3 and D3 prepared from a core seed crystal emulsion containing Compound 1-16 as a representative example of the compounds of the present invention represented by the formula (A), (B) or (C).

As mentioned above, the present invention can provide a tabular internal latent image type direct positive photographic silver halide emulsion which provides a high sensitivity and a low re-reversal negative sensitivity and a color diffusion transfer photographic light-sensitive material comprising such an emulsion.

The present invention also provides an internal latent image type direct positive photographic silver halide emulsion which can be prepared with a good reproducibility and a color diffusion transfer photographic light-sensitive material less susceptible to variation of sensitivity and S/N ratio comprising such an emulsion.

While the invention has been described in detail and with reference to specific embodiments thereof, it will be apparent to one skilled in the art that various changes and modifications can be made therein without departing from the spirit and scope thereof.

What is claimed is:

1. An internal latent image direct positive photographic silver halide emulsion comprising tabular silver halide grains having an average grain diameter of not less than 0.3 μm and an aspect ratio of from not less than 2 to not more than 100 in an amount of not less than 50% of all silver halide grains as calculated in terms of area; wherein said tabular silver halide grains are core/shell grains having a core and an external shell, the average grain thickness a along the main plane of the external shell thereof is from not less than 0.2 μm to not more than 1.5 μm and the average grain thickness b perpendicular to the main plane of the external shell thereof is from not less than 0.04 μm to not more than 0.30 μm;

wherein the thickness of grains are so uniform that the coefficient of variation of thickness is not more than 30%; and wherein the core of said core/shell grains are composed of silver bromide and are subjected to chemical sensitization in the presence of at least one compound selected from the group consisting of compounds represented by the following formula (A), (B) and (C) and a gold sensitizer in combination under the condition that substantially no thiosulfate ion is present during the chemical sensitization:

$$R—SO_2—S—M \quad (A)$$

$$R—SO_2—S—R^1 \quad (B)$$

$$R—SO_2S—(L)_m—SSO_2—R^2 \quad (C)$$

wherein R, $R^1$ and $R^2$ may be the same or different and each represents an aliphatic group, aromatic group or heterocyclic group; M represents a cation; L represents a divalent linking group; m represents 0 or an integer of 1; the compounds of the formula (A), (B) and (C) may be each in the form of a polymer containing, as a repeating unit, a divalent group derived from the structures represented, by the formulae (A), (B) and (C), respectively; and R, $R^1$, $R^2$ and L may be optionally connected to each other to form a ring.

2. The internal latent image direct positive photographic silver halide emulsion according to claim 1, wherein the external shell has an external phase which is chemically sensitized in the presence of at least one compound selected from the group consisting of the compounds represented by the formula (A), (B) and (C).

3. The internal latent image direct positive photographic silver halide emulsion according to claim 1, which is prepared from a seed crystal emulsion which has been prepared via desalting process.

4. The internal latent image direct positive photographic silver halide emulsion according to claim 1, wherein the average grain thickness a along the main plane of the external shell thereof is from not less than 0.4 μm to not more than 1.0 μm and the average grain thickness b perpendicular to the main plane of the external shell thereof is from not less than 0.06 μm to not more than 0.15 μm.

5. A color diffusion transfer photographic light-sensitive material comprising at least one photosensitive silver halide emulsion layer combined with a dye image-forming substance provided on a support, said dye image-forming substance comprising a nondiffusive compound represented by the following formula (I) which releases a diffusive dye or precursor thereof or changes in its diffusivity in connection with silver development, wherein said at least one silver halide emulsion layer comprises at least one internal latent image type direct positive photographic silver halide emulsion comprising tabular silver halide grains having a core/shell structure with a core and an external shell, composed of silver bromide, and having an average grain diameter of not less than 0.3 μm and an aspect ratio of from not less than 2 to not more than 100 in an amount of not less than 50% of all silver halide grains as calculated in terms of area, with the average grain thickness a along the main plane of the external shell thereof being from not less than 0.2 μm to not more than 1.5 μm and the average grain thickness b perpendicular to the main plane of the external shell thereof being from not less than 0.04 μm to not more than 0.30 μm; wherein grains are subjected to chemical sensitization in the presence of at least one compound selected from the group consisting of compounds represented by the following formula (A), (B) and (C):

$$R—SO_2—S—M \quad (A)$$

$$R—SO_2—S—R^1 \quad (B)$$

$$R—SO_2S—(L)_m—SSO_2—R^2 \quad (C)$$

wherein R, $R^1$ and $R^2$ may be the same or different and each represents an aliphatic group, aromatic group or heterocyclic group; M represents a cation; L represents a divalent linking group; m represents 0 or an integer of 1; the compounds of the formula (A), (B) and (C) may be each in the form of polymer containing as a repeating unit a divalent group derived from the structure represented by the formulae (A), (B) and (C), respectively; and R, $R^1$, $R^2$ and L may be optionally connected to each other to form a ring; and wherein formula (I) is as follows:

$$(DYE-Y)_n-Z \quad (I)$$

wherein DYE represents a dye group or a dye group precursor group whose absorption wavelength has been shifted to short wavelength; Y represents a mere bond or bridging group; Z represents a group which makes a difference in the diffusivity of the compound represented by $(DYE-Y)_n-Z$ or releases DYE to make a difference in diffusivity between the released DYE and $(DYE-Y)_n-Z$ in correspondence or counter correspondence to a photosensitive silver salt having an imagewise latent image; and n represents an integer of 1 or 2, with the proviso that when n is 2, the plurality of (DYE–Y)'s may be the same or different.

* * * * *